US012012677B2

(12) United States Patent
Lodrini et al.

(10) Patent No.: US 12,012,677 B2
(45) Date of Patent: Jun. 18, 2024

(54) CIRCULAR KNITTING MACHINE FOR MANUFACTURING OPEN-WORK KNITTED FABRIC

(71) Applicant: SANTONI S.P.A., Brescia (IT)

(72) Inventors: Maurizio Lodrini, Brescia (IT); Mauro Alghisi, Torbole Casaglia (IT)

(73) Assignee: SANTONI S.P.A., Brescia (IT)

( * ) Notice: Subject to any disclaimer, the term of this patent is extended or adjusted under 35 U.S.C. 154(b) by 285 days.

(21) Appl. No.: 17/442,199

(22) PCT Filed: Apr. 10, 2020

(86) PCT No.: PCT/IB2020/053439

§ 371 (c)(1),
(2) Date: Sep. 23, 2021

(87) PCT Pub. No.: WO2020/212816

PCT Pub. Date: Oct. 22, 2020

(65) Prior Publication Data

US 2022/0186412 A1 Jun. 16, 2022

(30) Foreign Application Priority Data

Apr. 16, 2019 (IT) ..... 102019000005892

(51) Int. Cl.
*D04B 9/38* (2006.01)
*D04B 1/10* (2006.01)
(Continued)

(52) U.S. Cl.
CPC ..... *D04B 9/38* (2013.01); *D04B 1/104* (2013.01); *D04B 15/06* (2013.01); *D04B 15/34* (2013.01); *D04B 15/78* (2013.01)

(58) Field of Classification Search
CPC ..... D04B 15/06; D04B 15/14; D04B 15/16; D04B 15/78
See application file for complete search history.

(56) References Cited

U.S. PATENT DOCUMENTS 1,912,474 A 6/1933 Cole et al.
5,931,025 A * 8/1999 Lonati ..... D04B 15/34 66/93
(Continued)

FOREIGN PATENT DOCUMENTS

CN 204039649 U 12/2014
EP 1524348 A1 4/2005
(Continued)

OTHER PUBLICATIONS

Search Report dated Jul. 20, 2020 in corresponding International Application No. PCT/IB2020/053439, 5 pages.
(Continued)

*Primary Examiner* — Danny Worrell
(74) *Attorney, Agent, or Firm* — MH2 TECHNOLOGY LAW GROUP LLP

(57) ABSTRACT

A circular knitting machine for manufacturing open-work knitted fabric includes a crown arranged around a needle-holding cylinder and having a plurality of radial grooves and a guiding ring operatively associated to the crown. Each of a plurality of knockover sinkers is housed in one of the radial grooves, is radially movable in the respective radial groove and has a pin configured for cooperating with the needles. At least one shaped sinker is placed beside each of the knock-over sinkers and is movable with respect to the respective knockover sinker. The shaped sinker has a protrusion offset laterally with respect to the respective knockover sinker and configured for elongating an interstitch, arranging it on an adjacent needle and forming an open work. A selector is operatively coupled with the shaped sinker and is oscillating in a radial plane between a rest position and an operating position, wherein in the operating position the selector acts indirectly upon the shaped sinker so as to deviate the trajectory of the shaped sinker. A selecting actuator faces laterally the crown and can be engaged upon command with
(Continued)

the selectors for causing the selectors to switch from the rest position to the operating position.

20 Claims, 13 Drawing Sheets

(51) Int. Cl.

| | |
|---|---|
| ***D04B 15/06*** | (2006.01) |
| ***D04B 15/34*** | (2006.01) |
| ***D04B 15/78*** | (2006.01) |

(56) References Cited

U.S. PATENT DOCUMENTS

| | | | | |
|---|---|---|---|---|
| 6,105,402 | A * | 8/2000 | Lee | D04B 15/34 66/227 |
| 7,065,989 | B2 * | 6/2006 | Lonati | D04B 15/06 66/93 |

FOREIGN PATENT DOCUMENTS

| | | | |
|---|---|---|---|
| FR | 1427471 | A | 2/1966 |
| JP | S49102961 | A | 9/1974 |
| WO | 2010035164 | A1 | 4/2010 |

OTHER PUBLICATIONS

Written Opinion dated Jul. 20, 2020 in corresponding International Application No. PCT/IB2020/053439, 13 pages.

* cited by examiner

CIRCULAR KNITTING MACHINE FOR MANUFACTURING OPEN-WORK KNITTED FABRIC

CROSS-REFERENCE TO RELATED APPLICATIONS

This application is a U.S. National Stage application of PCT/IB2020/053439 filed Apr. 10, 2020, pending, which claims priority to Italian Application No. 102019000005892 filed Apr. 16, 2019, the entire disclosures of which are hereby incorporated by reference.

FIELD OF THE INVENTION

The present invention relates to a circular knitting machine for manufacturing open-work knitted fabric. In particular, the present invention relates to the structure of those element which, by cooperating with the knockover sinkers and the needles, enable to manufacture said open-work knitted fabric. More specifically, the present invention relates to the individual selection of said elements enabling to produce openings in the knitted fabric by cooperating with some needles only, whereas adjacent needles make traditional stitches. Preferably, the present invention relates to circular knitting machines configured for manufacturing fabrics with intarsia motifs (intarsia machines or argyle machines).

BACKGROUND OF THE INVENTION

As is known, circular knitting machines comprise a needle-holding element (needle cylinder and/or plate) on which one or more series of needles are arranged along a circular path (circular needlebeds), and devices apt to control the movement of the needles for knitted fabric formation. Knockover sinkers are arranged in radial seats obtained in a ring-shaped body (sinker crown) arranged around the needle-holding cylinder, and said sinkers cooperate with the needles so as to make knitted fabric.

While executing particular designs with circular knitting machines, it is known to manufacture open-work knitted fabrics.

Document GB449404 discloses a circular knitting machine equipped with sinkers arranged between the needles and on which interstitch rings are formed. At least one of these sinkers comprises a protruding lateral portion, which is configured for moving an interstitch ring onto an adjacent needle so as to create an opening in the knitted fabric.

Document GB377794 discloses a circular knitting machine equipped with a spreader provided with a pair of blades placed on opposed sides of a sinker and configured for spreading an interstitch and arranging it on one or both adjacent needles.

Document GB410831 discloses a circular knitting machine comprising some sinkers provided with an upper hook or with a pair of hooks placed on the sides of a traditional sinker. Said hooks are configured and moved so as to displace an interstitch on a pair of adjacent needles and make an open work in the fabric. A selector moves the sinker with the hook integrated therein when said hook must work. The selector comprises an oscillating arm provided with butts interacting with a plurality of cams belonging to an actuating device.

It is further known about public document MI2003A001995, which discloses a device for selecting sinkers comprising, for each of the radial grooves housing the sinkers, a selector oscillating in a radial plane with respect to the sinker crown so as to switch between an operating position to a non-operating position or vice versa, which is connected to the corresponding sinker arranged in the corresponding radial groove, so as to induce a different actuation of the sinker depending on whether the selector is in the non-operating position or in the operating position. Moreover, a selecting actuator is provided, laterally facing the sinker crown and to be engaged upon command with the selector so as to switch it from the non-operating position to the operating position. When the selector is in the non-operating position, the selecting actuator does not intervene, the sinker is actuated by means of actuating cams only and cooperates with the needles for making plain stitches or however other than terry stitches. When the selector is switched to the operating position, said sinker is pushed towards the axis of the sinker crown more than the movement resulting from the actuating cams only, so as to cooperate with the needles in order to make terry stitches.

A circular knitting machine configured for manufacturing fabrics with intarsia motifs (intarsia machine) is disclosed for instance in document EP1620590 issued to the same Applicant.

Intarsia is a knitting technique enabling to obtain motifs using yarns of different colors in the same knitted course. Intarsia technique is usually used for creating multicolored motifs. As for woodworking technique, which it shares the name with, fields with different colors and materials seem to be fitted together as in a puzzle. Differently from other multicolor knitting techniques, there is only "active" color on a given stitch and the yarn is not moved to the reverse. When a color changes on a given row, the old yarn is left hanging.

SUMMARY

In the framework of circular knitting machines as the ones disclosed above, the Applicant has identified the presence of some drawbacks.

First of all, the Applicant has observed that some known machines are not able to individually select the elements designed to make an open work, since these elements are guided by cams and necessarily make all the same movements during each turn of the machines. As a result, the number, arrangement and other features of the open work to be made are preset and hard to change.

The Applicant has further observed that in the solutions described above the control of the elements designed to make the open work (sinkers with protruding lateral portion in GB449404, pair of blades in GB377794, sinkers provided with upper hook in GB410831), i.e. configured for selectively determining whether and when said elements should intervene, is left to complex mechanisms that are hard to configure (drum in GB449404, Dawson's wheel and cam in GB377794, selecting cams in GB410831).

Therefore, the Applicant has observed that known machines enabling the individual selection of the elements designed to make an open work are mechanically complex and bulky as well as expensive and difficult to be maintained.

Moreover, the Applicant has observed that known machines enabling the individual selection of said elements designed to make an open work, however, are not able to manufacture complex knitted fabrics since, one mechanically set, they will always make the same open work for a working cycle.

The Applicant has also observed that known machines enabling the individual selection of said elements are difficult to be reconfigured when the number, arrangement and/or other features of the open work need to be changed.

Under these circumstances, an aim underlying the present invention, in its various aspects and/or embodiments, is to propose a circular knitting machine enabling to manufacture open-work knitted fabrics with the most different features.

A further aim of the present invention is to propose a circular knitting machine which is able to manufacture open-work knitted fabrics and can be easily configured as a function of the features and positions of the open work to be obtained on the fabric.

Another aim of the present invention is to propose a circular knitting machine which is able to manufacture open-work knitted fabrics and is compact and relatively simple from a structural point of view as well as relatively cheap and easily maintained.

A further aim of the present invention is to provide a circular knitting machine which is able to manufacture highly complex open-work knitted fabrics in relatively short manufacturing times.

A further aim of the present invention is to provide a circular knitting machine which is able to manufacture open-work knitted fabrics enabling also to obtain further motifs and/or effects on the knitted fabric, preferably without having to reconfigure the machine itself or parts of it from a mechanical point of view.

A further aim of the present invention is to provide a circular knitting machine configured for manufacturing fabrics with intarsia motifs (intarsia machine or argyle machine), which is also able to manufacture open-work knitted fabrics according to the aims listed above.

These and other possible aims, which shall appear better from the following description, are basically achieved by a circular knitting machine for manufacturing open-work knitted fabric according to one or more of the appended claims and according to the following aspects and/or embodiments, variously combined, possibly also with the aforesaid claims.

In the present description and in the appended claims, the words "upper", "lower", "above" and "below" relate to the positioning of the machine during normal operation with the central axis of rotation in vertical position and the cylinder needles with their heads pointing upwards.

In the present description and in the appended claims, the words "axial", "circumferential", "radial" relate to said central axis.

Some aspects of the invention are listed below.

In one aspect, the invention relates to a circular knitting machine for manufacturing open-work knitted fabric.

The machine comprises:

- a needle-holding cylinder having a plurality of longitudinal grooves arranged around a central axis of the needle-holding cylinder;
- a plurality of needles, each being housed in a respective longitudinal groove;
- at least one yarn feed operatively associated to the needles;
- a crown arranged around the needle-holding cylinder and having a plurality of radial grooves;
- at least one guiding ring operatively associated to the crown, wherein the crown is rotatable with respect to the guiding ring and around the central axis;
- a plurality of knockover sinkers, each housed in one of the radial grooves and radially movable in the respective radial groove, each knockover sinker having a pin configured for cooperating with the needles and a butt engaged with a first guide obtained in the guiding ring and developing around the central axis; wherein the first guide is configured for moving the knockover sinker radially along the respective radial groove when the crown rotates with respect to the guiding ring and around the central axis.

In one aspect, the machine comprises at least one shaped sinker placed beside each of the knockover sinkers, wherein the shaped sinker is movable with respect to the respective knockover sinker, wherein the shaped sinker has a protrusion placed above the respective knockover sinker and laterally offset with respect to said knockover sinker, wherein the protrusion is configured for loading and extending the interstitch and place it on an adjacent needle of said plurality of needles and make an open work, wherein the shaped sinker has a butt that is or can be engaged with a second guide obtained in the guiding ring and developing around the central axis, wherein the second guide defines a plurality of trajectories for the shaped sinker, wherein the second guide is configured for moving the shaped sinker radially when the crown rotates with respect to the guiding ring and around the central axis.

In one aspect, the machine comprises at least one selector operatively coupled with said at least one shaped sinker, wherein the selector is movable, preferably oscillating, in a radial plane between a rest position and an operating position, wherein in the operating position the selector acts directly or indirectly upon said at least one shaped sinker so as to deviate the butt of the shaped sinker along a trajectory of the second guide.

In one aspect, the machine comprises at least one selecting actuator laterally facing the crown, fixed with respect to the guiding ring, that can be engaged under control with the selectors and is configured for causing the selectors to switch from the rest position to the operating position.

The Applicant has found out that the invention enables to solve the problems listed above related to the prior art and thus to obtain the intended aims.

The Applicant has first found out that the invention enables to manufacture highly complex open-work knitted fabrics in relatively short times.

The Applicant has further found out that the invention enables to manufacture open-work knitted fabrics of various types and with the most different features.

As a matter of fact, the invention enables to precisely select the shaped sinkers that are required for making the open work to be obtained by activating or not the respective selectors. Moreover, since the shaped sinkers are independent with respect to the knockover sinkers, their movement and function are not hindered by the presence and/or by the movements of said knockover sinkers.

The Applicant has also found out that the machine according to the invention is highly flexible since it allows to switch from manufacturing a type of knitted fabric to a different type in a fast and relatively simple manner, acting upon the selecting actuators.

Further aspects of the invention are listed below.

In one aspect, the circular knitting machine is an intarsia machine, i.e. a machine configured for manufacturing fabrics with intarsia motifs (intarsia machine or argyle machine).

In one aspect, the circular intarsia knitting machine comprises at least two yarn feeds, each one configured for working with a respective group of needles arranged along an arc of circle by means of an alternating rotary motion of the needles around the central axis.

In one aspect, said at least two feeds cooperate to form every knitted course by rotating in both directions. In one aspect, at least one motor is operatively connected to the needle-holding cylinder and to the crown so as to make them rotate around the central axis.

In one aspect, cams and/or other types of devices are arranged around the needle-holding cylinder so as to turn the rotational motion of the needle-holding cylinder into an axial motion of the needles.

In one aspect, the machine comprises a plurality of yarn feeds, preferably one, more preferably two or four thereof.

In one aspect, the machine comprises a plurality of selecting actuators, preferably each one placed on a yarn feed.

In one aspect, said at least one shaped sinker comprises a right shaped sinker and a left shaped sinker, arranged on opposed sides of the respective knockover sinker.

In one aspect, the right shaped sinker and the left shaped sinker exhibit respective protrusions that are laterally offset towards opposed sides of said knockover sinker and preferably placed above the respective knockover sinker.

In one aspect, the protrusions are configured for loading and stretching the interstitch and arrange it on two adjacent needles placed on opposed sides of the respective knockover sinker and form the open work. The use of two shapes sinkers for every knockover sinker allows to make wider, better defined open works, thus obtaining a balanced knitted fabric without twists or folds.

In one aspect, said at least one shaped sinker is housed in one of the radial grooves together with the respective knockover sinker.

In one aspect, a first assembly made up of the knockover sinker and by the shaped sinker, or by the right shaped sinker and by the left shaped sinker, is housed in one of the radial grooves. The radial groove houses the whole first assembly so as to reduce the overall size.

In one aspect, the shaped sinker is a flat element, preferably made of metal.

In one aspect, each knockover sinker comprises a main body and the protrusion is laterally offset with respect to the main body.

In one aspect, the main body lies basically in a plane.

In one aspect, the main body comprises a horizontal flat bar and a vertical flat upright developing from the horizontal flat bar, wherein the protrusion is arranged on an upper end of the flat upright.

In one aspect, the right shaped sinker and the left shaped sinker exhibit respective protrusions that are laterally offset in opposed directions with respect to their main body.

In one aspect, the butt of the shaped sinker is flat and extends vertically from the flat bar.

In one aspect, the butt of the shaped sinker is positioned on a radially outer end of the main body.

In one aspect, the butt of the shaped sinker points upwards.

In one aspect, the selector acts indirectly upon an end of said at least one shaped sinker that is radially opposed to the protrusion.

In one aspect, each selector acts indirectly upon the right shaped sinker and/or on the left shaped sinker.

In one aspect, the selector is a flat element, preferably made of metal.

In one aspect, the selector exhibits a base portion configured for oscillating around an axis tangent to a horizontal circumference with its center in the central axis.

In one aspect, the selector exhibits an abutment portion at a distance from the base portion, pointing towards the central axis and configured for directly or indirectly acting upon the shaped sinker.

In one aspect, the selector has at least one tooth radially pointing outwards, i.e. on the side opposed to the central axis, and configured for interacting with the selecting actuator.

In one aspect, the guiding ring comprises a circular track extending around the central axis.

In one aspect, each selector, preferably, the base portion of each selector, is slidingly engaged into the circular track so as to rotate together with said at least one shaped sinker.

In one aspect, the knockover sinker is a flat element, preferably made of metal.

In one aspect, the knockover sinker comprises a main body and the respective pin is arranged above the main body.

In one aspect, the main body lies basically in a plane.

In one aspect, the main body comprises a horizontal flat bar and a vertical flat upright developing from the horizontal flat bar, wherein the pin is arranged on an upper end of the flat upright.

In one aspect, the butt of the knockover sinker is flat and extends vertically from the flat bar.

In one aspect, the butt of the knockover sinker is placed at a distance from a radially outer end of the main body of the knockover sinker.

In one aspect, the butt of the knockover sinker points upwards.

In one aspect, when the knockover sinker is associated to the shaped sinker, or to the right shaped sinker and to the left shaped sinker, in the respective groove, the butt of the knockover sinker is radially placed between the butt and the protrusion of the shaped sinker.

In one aspect, each knockover sinker is operatively uncoupled from the selector, i.e. the selector does not interact with the knockover sinker and does not cause movements thereof.

In one aspect, each knockover sinker is operatively associated to a respective selector.

In one aspect, the selector of the knockover sinker is movable, preferably oscillating, in a radial plane between a rest position and an operating position.

In one aspect, in the operating position the selector of the knockover sinker acts directly or indirectly upon the knockover sinker so as to deviate the butt of the knockover sinker along a trajectory of the first guide.

In one aspect, the knockover sinker further comprises a spring arranged above the pin and configured with making different stitches, preferably terry stitches.

In one aspect, the machine comprises a plurality of pushing units, each associated to a selector and to said at least one shaped sinker.

In one aspect, in the operating position the selector rests against the pushing unit and the pushing unit is configured for pushing against said at least one shaped sinker.

The use of the pushing units, which are operatively placed between the selectors and the shaped sinkers, allows the selectors to indirectly act upon the shaped sinkers.

In one aspect, the machine comprises a plurality of pushing units, each associated to a selector of a knockover sinker.

In one aspect, the pushing unit is a flat element, preferably made of metal.

In one aspect, the guiding ring comprises a third guide extending around the central axis and defining a plurality of trajectories.

In one aspect, each pushing unit exhibits a butt that is or can be engaged with the third guide.

In one aspect, the pushing unit comprises a horizontal flat bar, wherein the butt is positioned on a radially outer end of the horizontal flat bar.

In one aspect, the butt of the pushing unit is flat and extends vertically from the horizontal flat bar.

In one aspect, the butt of the pushing unit points upwards.

In one aspect, the pushing unit has an abutment surface facing the central axis and configured for resting against the respective shaped sinker or knockover sinker.

In one aspect, the pushing unit is housed in the radial groove together with the respective knockover sinker and with said at least one shaped sinker.

In one aspect, a first assembly made up of the knockover sinker, of the right shaped sinker, of the left shaped sinker and of the respective pushing units (one for the right shaped sinker and one for the left shaped sinker or only one acting both against the right shaped sinker and against the left shaped sinker) is housed in one of the radial grooves.

In one aspect, the abutment surface of the pushing unit is placed near the butt of said pushing unit.

In one aspect, said abutment portion of the respective selector faces a radially outer end of the pushing unit, preferably of the horizontal flat bar of said pushing unit.

In one aspect, the abutment portion of the selector is sized so as to rest both against the pushing unit associated to the right shaped sinker and against the pushing unit associated to the left shapes sinker, preferably simultaneously or almost simultaneously.

In one aspect, a part of the pushing unit, preferably the horizontal flat bar of the pushing unit, is placed below the respective shaped sinker and/or knockover sinker, preferably of the horizontal flat bar of said shaped sinker and/or knockover sinker.

In one aspect, the crown exhibits a plurality of auxiliary radial grooves, each placed between two radial grooves.

In one aspect, the machine comprises a plurality of auxiliary knockover sinkers, each housed in one of the auxiliary radial grooves and radially movable in the respective auxiliary radial groove.

In one aspect, each auxiliary knockover sinker has a pin configured for cooperating with the needles and a butt engaged with the first guide.

In one aspect, the first guide is configured for moving the auxiliary knockover sinker radially along the respective auxiliary radial groove when the crown rotates with respect to the guiding ring and around the central axis.

In one aspect, the auxiliary knockover sinker further comprises a spring arranged above the pin and configured with making different stitches, preferably terry stitches.

In one aspect, except for the spring, the auxiliary knockover sinker is identical with the knockover sinker.

In one different aspect, the auxiliary knockover sinker is identical with the knockover sinker.

In one aspect, the auxiliary knockover sinker comprises a main body and the respective pin is arranged above the main body.

In one aspect, the main body lies basically in a plane.

In one aspect, the main body comprises a horizontal flat bar and a vertical flat upright developing from the horizontal flat bar, wherein the develops from the flat upright.

In one aspect, the butt of the auxiliary knockover sinker is flat and extends vertically from the flat bar.

In one aspect, the butt of the auxiliary knockover sinker is placed at a distance from a radially outer end of the main body of the auxiliary knockover sinker.

In one aspect, the butt of the auxiliary knockover sinker points upwards.

In one aspect, an auxiliary selector is operatively coupled with each auxiliary knockover sinker.

In one aspect, the auxiliary selector is movable in a radial plane between a rest position and an operating position.

In one aspect, in the operating position the auxiliary selector acts indirectly upon said at least one auxiliary knockover sinker so as to deviate the butt of the auxiliary knockover sinker along a trajectory of the first guide.

In one aspect, the auxiliary selector acts indirectly upon an end of the respective auxiliary knockover sinker that is radially opposed to the pin.

In one aspect, the auxiliary selector is similar to said selector.

In one aspect, the auxiliary selector is a flat element, preferably made of metal.

In one aspect, the auxiliary selector exhibits a base portion configured for oscillating around an axis tangent to a horizontal circumference with its center in the central axis.

In one aspect, the auxiliary selector exhibits an abutment portion at a distance from the base portion, pointing towards the central axis and configured for directly or indirectly acting upon the auxiliary knockover sinker.

In one aspect, the auxiliary selector has at least one tooth radially pointing outwards, i.e. on the side opposed to the central axis, and configured for interacting with the selecting actuator.

In one aspect, each auxiliary selector is slidingly engaged into the circular track so as to rotate together with the respective auxiliary knockover sinker.

In one aspect, each auxiliary selector, preferably the base portion of each auxiliary selector, is slidingly engaged into the circular track so as to rotate together with said at least one auxiliary knockover sinker.

In one aspect, it is proved for a plurality of auxiliary pushing units, each associated to a respective auxiliary selector and to said at least one auxiliary knockover sinker.

In one aspect, in the operating position the auxiliary selector rests against the pushing unit and the auxiliary pushing unit is configured for pushing against said at least one auxiliary knockover sinker.

The use of the auxiliary pushing units, which are operatively placed between the auxiliary selectors and the auxiliary knockover sinkers, allows the selectors to indirectly act upon the auxiliary knockover sinkers.

In one aspect, the auxiliary pushing units are identical with the pushing units.

In one aspect, the auxiliary pushing unit is a flat element, preferably made of metal.

In one aspect, each auxiliary pushing unit exhibits a butt that is or can be engaged with the third guide.

In one aspect, the auxiliary pushing unit comprises a horizontal flat bar, wherein the butt is positioned on a radially outer end of the horizontal flat bar.

In one aspect, the butt of the auxiliary pushing unit is flat and extends vertically from the horizontal flat bar.

In one aspect, the butt of the auxiliary pushing unit points upwards.

In one aspect, the pushing unit has an abutment surface facing the central axis and configured for resting against the respective auxiliary knockover sinker.

In one aspect, the auxiliary pushing unit is housed in the auxiliary radial groove together with the respective auxiliary knockover sinker.

In one aspect, a second assembly made up of the auxiliary knockover sinker and of the respective auxiliary pushing unit is housed in one of the auxiliary radial grooves.

In one aspect, the abutment surface of the auxiliary pushing unit is placed near the butt of said auxiliary pushing unit.

In one aspect, said abutment portion of the respective auxiliary selector faces a radially outer end of the auxiliary pushing unit, preferably of the horizontal flat bar of said auxiliary pushing unit.

In one aspect, a part of the auxiliary pushing unit, preferably the horizontal flat bar of the auxiliary pushing unit, is placed below the respective auxiliary knockover sinker, preferably of the horizontal flat bar of said auxiliary knockover sinker.

In one aspect, the first guide is radially further inner with respect to the second guide.

In one aspect, the first guide comprises some portions provided with a radially outer path and with a radially inner path.

In one aspect, the first guide defines at least one first trajectory comprising radially outer paths for some of said portions and radially inner paths for others of said portions.

In one aspect, the first guide defines a second trajectory comprising radially inner paths for all of said portions.

In one aspect, two of said portions are placed upstream and downstream of each yarn feed.

In one aspect, the first guide is located above the knockover sinkers and/or the auxiliary knockover sinkers.

In one aspect, the second guide defines a radially outer trajectory, a radially inner trajectory and a plurality of connecting portions between the radially outer trajectory and the radially inner trajectory.

In one aspect, the second guide is located above the shaped sinkers.

In one aspect, the third guide defines a radially outer trajectory and a plurality of radially inner trajectories placed one after the other around the central axis.

In one aspect, each of the radially inner trajectories has opposed ends connected to the radially outer trajectory.

In one aspect, each of the radially inner trajectories is curved.

In one aspect, the third guide is located above the pushing units and/or the auxiliary pushing units.

In one aspect, the second guide is radially further inner with respect to the radially outer trajectory of the third guide.

In one aspect, each of the radially inner trajectories of the third guides also defines a respective connecting portions of the second guide.

In one aspect, the circular track is radially further outer with respect to the second guide.

In one aspect, the circular track is radially further outer with respect to the radially outer trajectory of the third guide.

In one aspect, said at least one selecting actuator comprises at least one selecting lever movable between a first position, in which it lies at a distance from the selectors and from the auxiliary selectors, and a second position, in which it interferes with the selectors or with the auxiliary selectors moving in front of the selecting actuator when the crown rotates with respect to the guiding ring and around the central axis, so as to move the selectors or the auxiliary selectors from the rest position to the operating position.

In one aspect, the selecting actuator is of magnetic or piezoelectric type.

In one aspect, the present invention also relates to a method for manufacturing knitted fabric using a machine according to one or more of the preceding aspects.

In one aspect, the method comprises: keeping the selectors and the auxiliary selectors in the rest position, while the crown rotates with respect to the guiding ring and around the central axis, so as to move the shaped sinkers along the radially outer trajectory of the second guide and to move the auxiliary knockover sinkers along the first trajectory of the first guide, wherein the knockover sinkers move along said first trajectory of the first guide like the auxiliary knockover sinkers, so as to make a plain knitted fabric.

In one aspect, the method comprises: engaging said at least one selecting actuator with at least one of the selectors so as to move said at least one second selector in the operating position for at least one rotational portion of the crown around the central axis, wherein the auxiliary selectors are kept in the rest position, so as to move said at least one shaped sinker associated to said at least one selector on the radially inner trajectory of the second guide and move the protrusion towards the central axis for at least one rotational portion of the crown around said central axis, so as to make, by cooperating with at least one needle, an open work in the knitted fabric.

In one aspect, the pushing unit associated to at least one of the selectors is pushed by the respective selector radially towards the central axis, gets on one of the radially inner trajectories and pushed said at least one shaped sinker on the radially inner trajectory of the second guide, so as to load an interstitch onto said at least one protrusion.

In one aspect, the shaped sinker gets back from the radially inner trajectory of the second guide to the radially outer trajectory of the second guide, so as to transfer the interstitch to at least one adjacent needle.

In one aspect, said at least one shaped sinker is pushed onto the radially inner trajectory of the second guide, while the crown rotates in first sense with respect to the guiding ring.

In one aspect, said at least one shaped sinker gets back to the radially outer trajectory of the second guide, while the crown rotates in second sense, opposed to the first sense, with respect to the guiding ring.

In one aspect, the method comprises: engaging said at least one selecting actuator with at least one of the auxiliary selectors so as to move said at least one auxiliary selector in the operating position for at least one rotational portion of the crown around the central axis, wherein the selectors are kept in the rest position, so as to move said at least one auxiliary knockover sinker associated to said at least one auxiliary selector on the second trajectory of the first guide, so that the spring of the auxiliary knockover sinker makes a terry stitch by cooperating with at least one needle, using at least two yarns.

Further characteristics and advantages shall be more evident from the detailed description of a preferred embodiment of a circular knitting machine for manufacturing an open-work knitted fabric and of a method for manufacturing knitted fabric according to the present invention.

DESCRIPTION OF THE DRAWINGS

This description shall be made below with reference to the accompanying drawings, provided to a merely indicative and therefore non-limiting purpose, in which.

DETAILED DESCRIPTION

Figure 1:
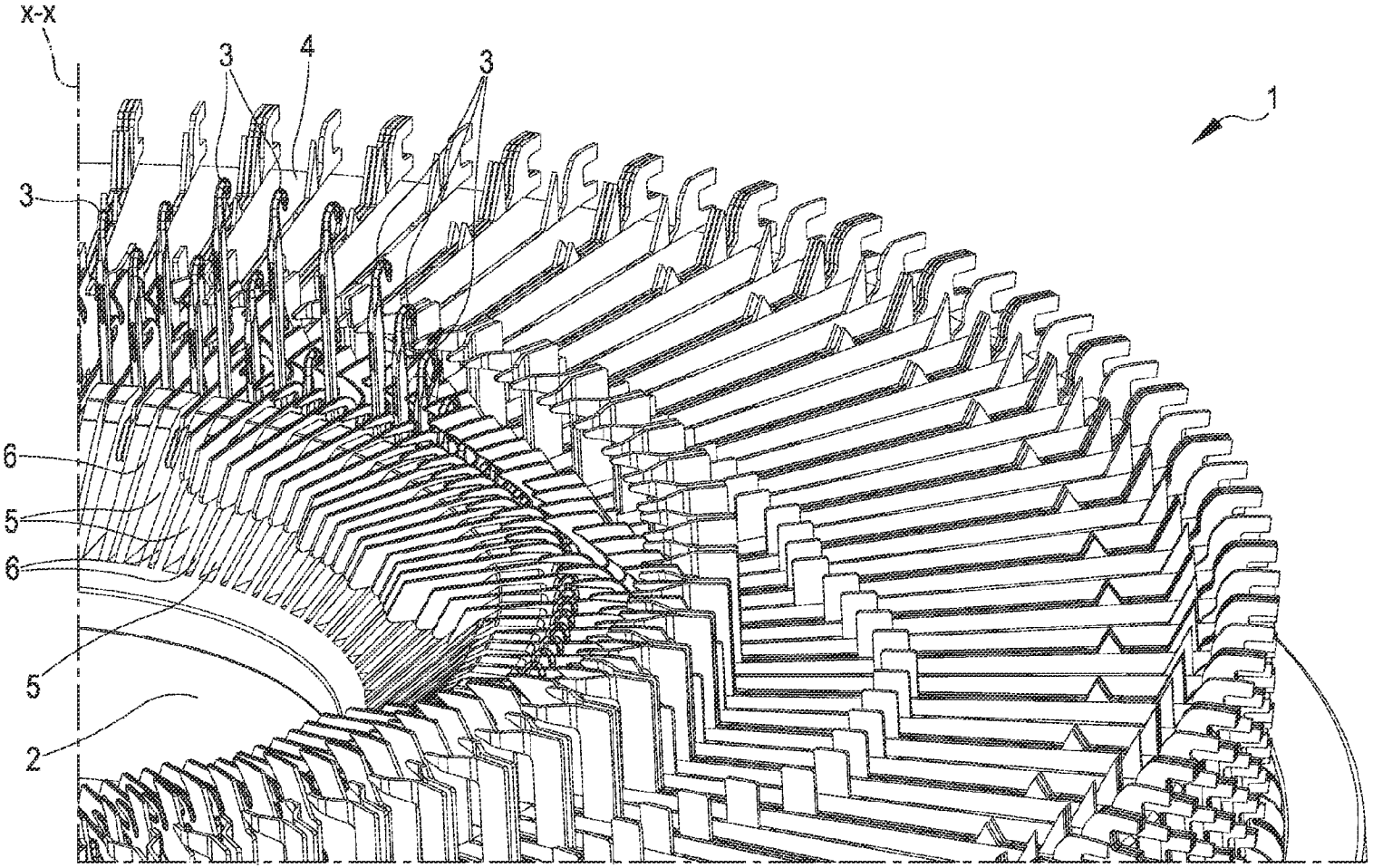
FIG. 1 shows a portion of a circular knitting machine according to the present invention with some parts removed for better showing others.

With reference to the figures mentioned, the numeral 1 globally designates a portion of a knitting head of a circular knitting machine according to the present invention. The circular knitting machine shown is a machine configured for manufacturing fabrics with intarsia motifs (intarsia machine or argyle machine). The circular knitting machine comprises a basement, not shown since it is of known type, constituting the supporting structure of the machine, and said knitting head 1 is mounted onto the basement.

The knitting head 1 is equipped with a needle-holding cylinder 2, with a plurality of needles 3 mounted onto the needle-holding cylinder 2, and with control means, not shown, apt to selectively actuate the needles 3 so as to enable the production of a fabric. The needle-holding cylinder 2 is usually mounted in vertical position onto the basement, with the needles 3 arranged vertically and protruding beyond an upper edge of the needle-holding cylinder 2.

As is known, the needle-holding cylinder 2 has a plurality of longitudinal grooves obtained on a radially outer surface of the needle-holding cylinder 2. The longitudinal grooves are arranged around a central axis "X-X" (vertical) of the needle-holding cylinder 2 and develop parallel to said central axis "X-X". Each longitudinal groove houses a respective needle 3 and a respective drive chain comprising a plurality of flat parts. Actuating cams are arranged as a casing around the needle-holding cylinder 2 and lie facing the radially outer surface of the cylinder 2 and thus the longitudinal grooves and the drive chains. These actuating cams are defined e.g. by plates and/or grooves arranged on an inner surface of the casing.

In one embodiment, the casing of the actuating cams is basically stationary, whereas the needle-holding cylinder 2 rotates (with a continuous or alternating motion in both directions) around the central axis "X-X" by means of a suitable motor, so as to generate a relative rotational motion between the drive chains and the actuating cams and turn the rotational motion of the needle-holding cylinder 2 into an axial motion of the needles 3 in order to manufacture knitted fabric by means of the said needles 3.

The machine further comprises a crown 4 arranged around the needle-holding cylinder 2 and having a plurality of radial grooves 5 and auxiliary radial grooves 6 that are open on a radially inner edge of the crown 4, i.e. towards the central axis "X-X". The radial grooves 5 and the auxiliary radial grooves 6 alternate along a circumferential development of the crown 4, i.e. each radial groove 5 is flanked by two auxiliary radial grooves 6 and each auxiliary radial groove 6 is flanked by two radial grooves 5. The crown 4 is moved in rotation around the central axis "X-X" together with the needle-holding cylinder 2, e.g. by means of the same motor.

Suitable devices, not shown, feed the yarns to be knitted on one or more yarn feeding points (known as feeds) usually arranged above the needle-holding cylinder 2. The circular intarsia knitting machine shown comprises four yarn feeds, each one configured for working with a respective group of needles 3 arranged along an arc of circle (e.g. a 90° arc) by means of an alternating rotary motion of the needles 3 around the central axis "X-X". The four feeds cooperate to form every knitted course by rotating in both directions.

Figure 4:
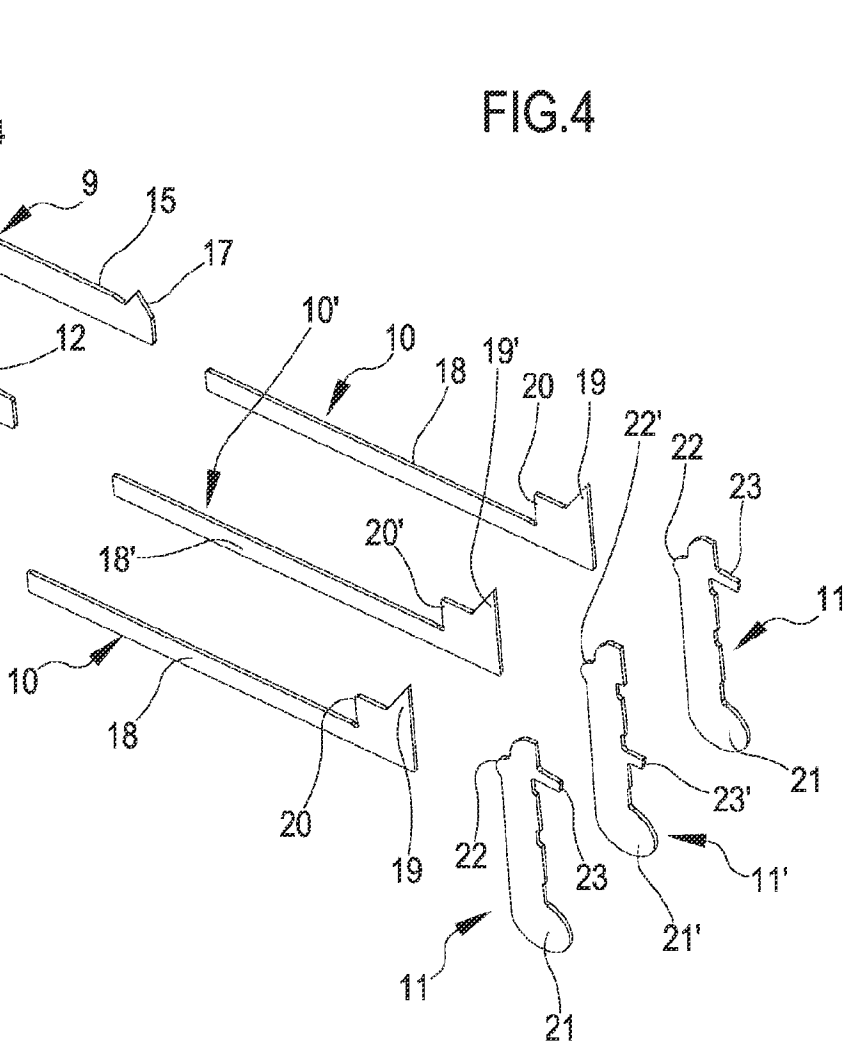
FIG. 4 shows an exploded view of an assembly of elements belonging to the machine as in the preceding figures, which can be seen in FIG. 3.

Each of the radial grooves 5 houses a first assembly made up of a plurality of metal flat parts that can slide radially in the respective radial groove 5 and also one with respect to the other. This first assembly, better shown in FIGS. 4 and 5, comprises a knockover sinker 7, a right shaped sinker 8, a left shaped sinker 9, two pushing units 10, one associated to the right shaped sinker 8 and the other one to the left shaped sinker 9, and a selector 11 for each of the pushing units 10.

The knockover sinker 7 comprises a main body shaped as a horizontal flat bar 12 oriented as the groove 5, i.e. along a radial direction, and a vertical flat upright developing from the horizontal flat bar 12. A pin 13 having a per se known shape is arranged on an upper end of the vertical flat upright and faces the central axis "X-X" when the first assembly is properly mounted to the machine. The knockover sinker 7 further comprises a flat butt 14 extending vertically upwards from the horizontal flat bar 12 and at a distance from a radially outer end (with respect to the central axis "X-X") of the horizontal flat bar 12. The knockover sinker 7 is made up of a single flat metal part, e.g. a cut part.

The right shaped sinker 8 comprises a main body shaped as a horizontal flat bar 15 and a vertical flat upright developing from the horizontal flat bar 15. A protrusion 16 is arranged on an upper end of the flat upright. The protrusion 16 extends like a sort of arm, when the first assembly is properly mounted to the machine, towards the central axis "X-X" and is offset laterally with respect to a lying plane of the respective main body. The right shaped sinker 8 further comprises a flat butt 17 extending vertically upwards from the horizontal flat bar 15 and is placed near a radially outer end (with respect to the central axis "X-X") of the horizontal flat bar 15. The right shaped sinker 8 is made up of a single flat metal part, e.g. a cut, stamped and/or bent part.

The left shaped sinker 9 comprises the same elements as the right shaped sinker 8 and is structurally identical with or corresponding to the right shaped sinker 8, except for the fact that the respective protrusion 16 is offset/displaced, with respect to its main body, to the opposed side. The right shaped sinker 8 and the left shaped sinker 9 therefore have respective protrusions 16 that are laterally displaced in opposed directions with respect to its main body and with respect to the knockover sinker 7 placed between them.

Figure 5:
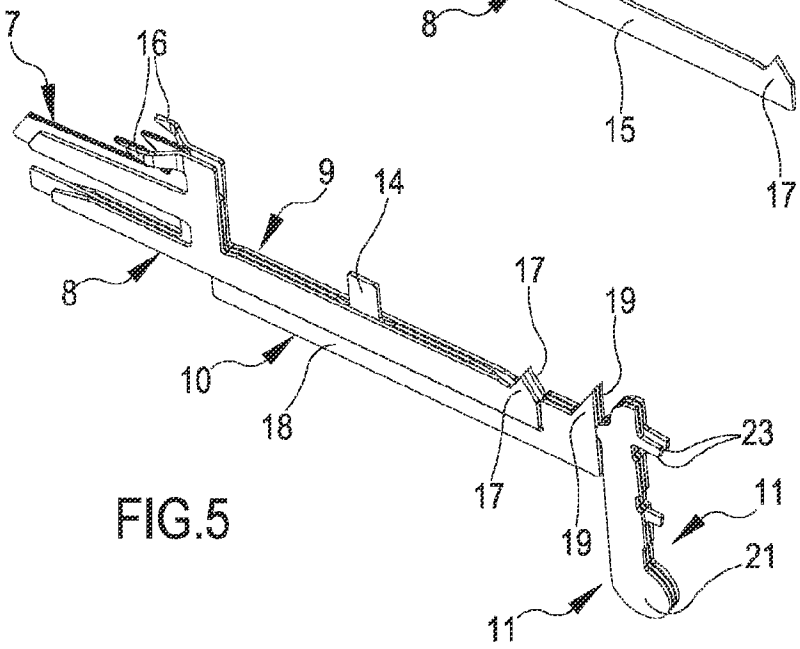
FIG. 5 shows the assembly of FIG. 4 with the elements associated to one another.

When the first assembly is properly mounted in the respective groove 5, the right shaped sinker 8 and the left shaped sinker 9 are arranged on opposed sides of the respective knockover sinker 7 (FIG. 5). The right shaped sinker 8 and the left shaped sinker 9 exhibit respective protrusions 16 that are laterally offset towards opposed sides of said knockover sinker 7 and placed above the pin 13 of the respective knockover sinker 7. Moreover, the butt 14 of the knockover sinker 7 is radially placed between the butt 17 and the protrusion 16 of the respective shaped sinkers 8, 9.

The two pushing units 10 of the first assembly are identical with one another. Each of the pushing units 10 comprises a horizontal flat bar 18 and a butt 19 that is flat, is placed on a radially outer end, with respect to the central axis "X-X", of the horizontal flat bar 18 and extends vertically upwards. The pushing unit 10 further has an abutment surface 20 facing the central axis "X-"X and configured for resting against the respective shaped sinker 8, 9. The abutment surface 20 of the pushing unit 10 is placed near the butt 19 of said pushing unit 10, i.e. near said radially outer end of the horizontal flat bar 18. More particularly, a portion of the pushing unit placed near said radially outer end extends vertically upwards and defines the abutment surface 20 and the respective butt 19. Also the pushing unit 10 is made up of a single flat metal part, e.g. a cut part.

When the first assembly is properly mounted in the respective groove 5 (FIG. 5), the horizontal flat bar 18 of each pushing unit 10 is located under and in contact with the flat bar 15 of the respective shaped sinker 8, 9 and the abutment surface 20 faces the radially outer end of the respective shaped sinker 8, 9. The knockover sinker 7 is placed between the first and the second shaped sinker 8, 9.

Each of the two selectors 11 is a metal, basically flat element mainly developing vertically when it is properly mounted in the machine. The selector 11 has a base portion 21 with a rounded profile and configured for oscillating around an axis tangent to a horizontal circumference with its center in the central axis "X-X". The selector 11 lies and oscillates in a radial plane. The selector 11 further exhibits an abutment portion 22 at a distance from the base portion 21, pointing towards the central axis "X-X" and configured for indirectly acting upon the respective shaped sinker 8, 9 through the respective pushing unit 10. The selector 11 further has a tooth 23 located on an edge of the flat element radially opposed to the abutment portion 22 and radially pointing outwards, i.e. to the opposed side with respect to the central axis "X-X".

The abutment portion 22 has a rounded projection configured and sized for resting against the radially outer end of the horizontal flat bar 18 of the respective pushing unit 10 of the first assembly.

Each selector 11 is oscillating in the radial plane between a rest position and an operating position. In the rest position, the abutment portion 22 of the selector 11 is located in a radially outer position and does not get in contact with the respective pushing unit 10. In the operating position, the selector 11 is rotated towards the central axis "X-X", the abutment portion 22 of the selector 11 is located in a radially inner position and is configured for resting and pushing against the respective pushing unit 10 towards the central axis "X-X". The pushing units 10 are configured in their turn for pushing the shaped sinkers 8, 9.

Figure 2:
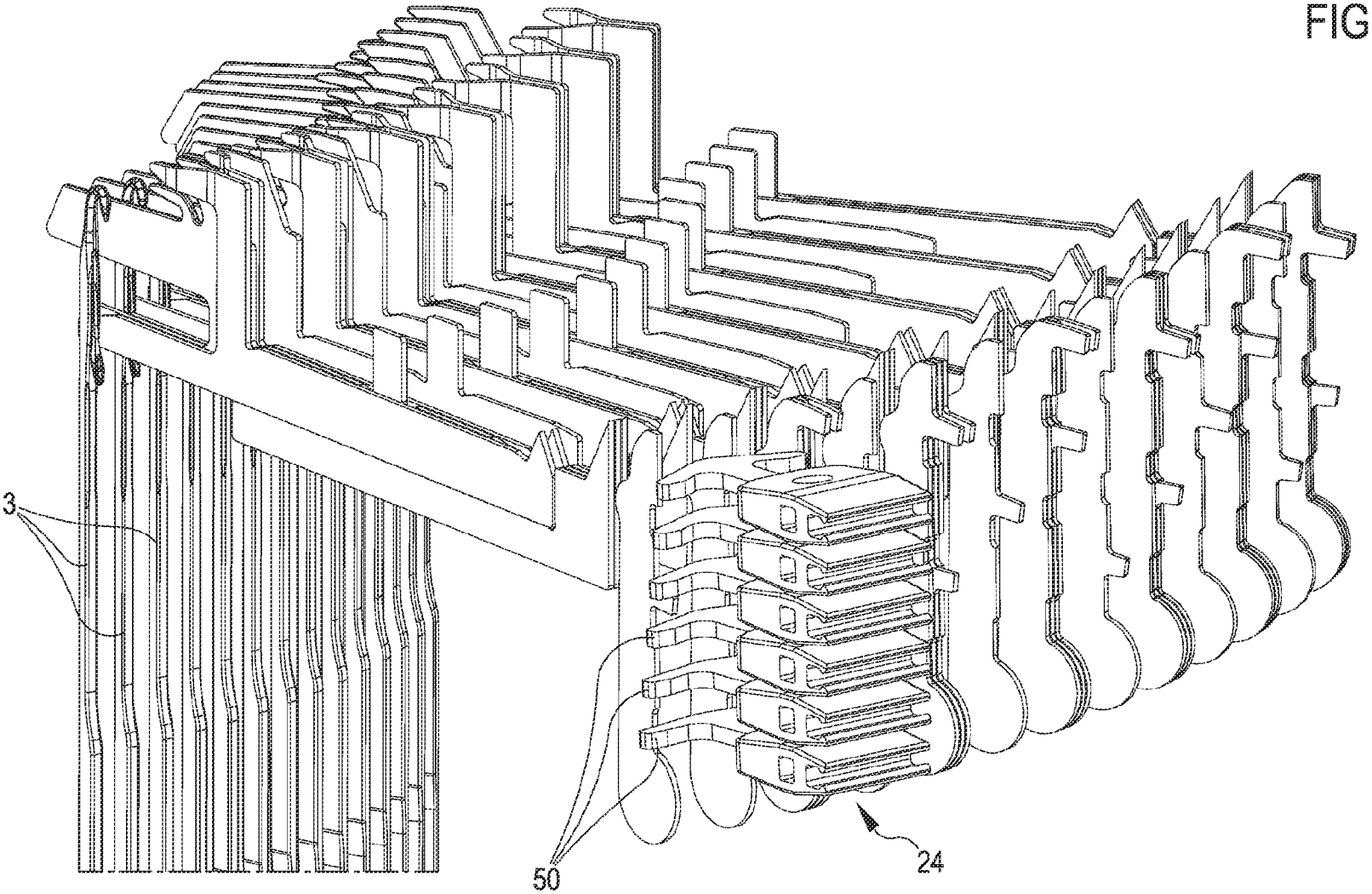
FIG. 2 shows the portion of FIG. 1 with other parts removed for better showing other elements of the machine as in the preceding figures.
Figure 3:
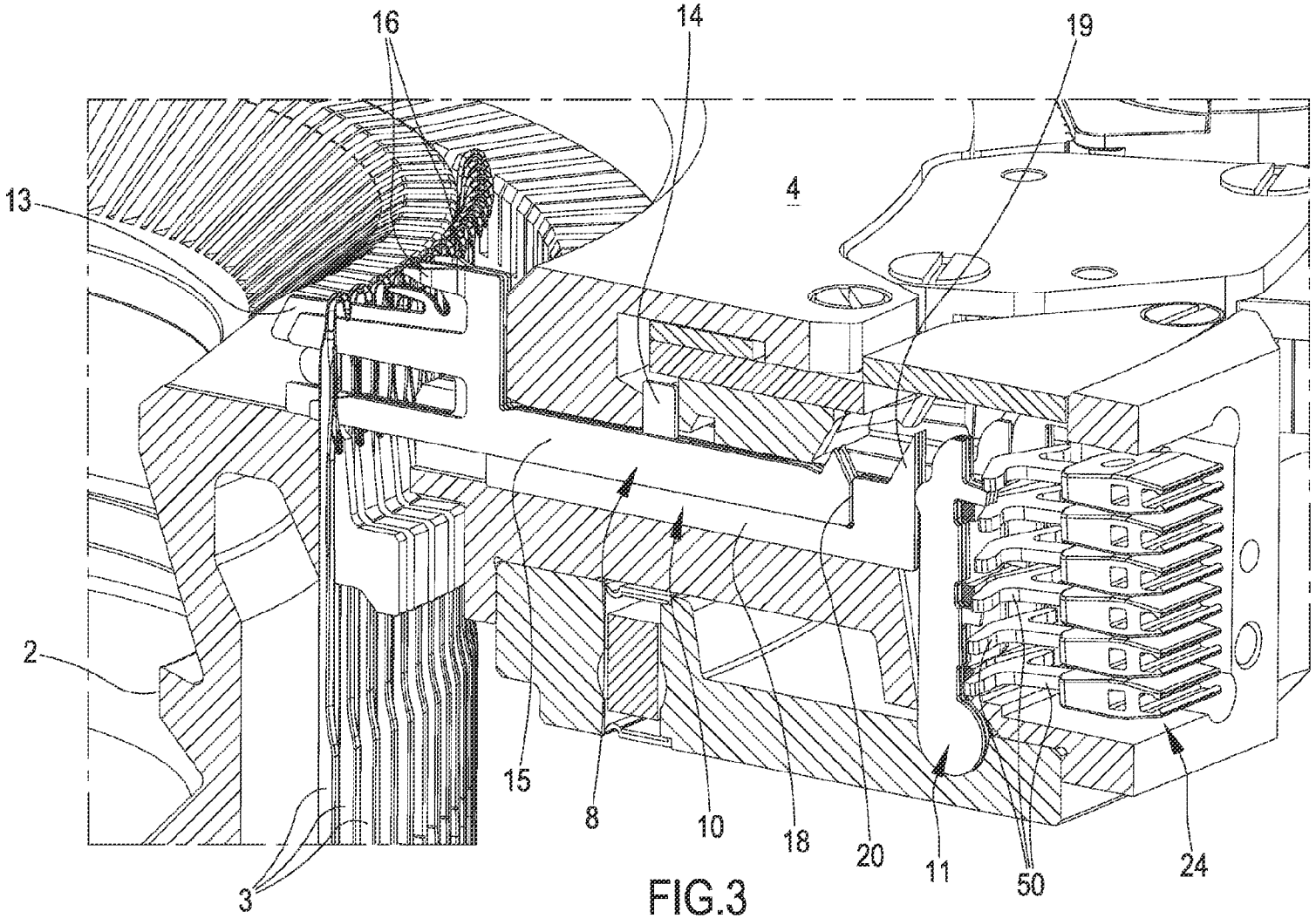
FIG. 3 shows a different, partially sectioned view of the portion of FIG. 1.
Figure 8:
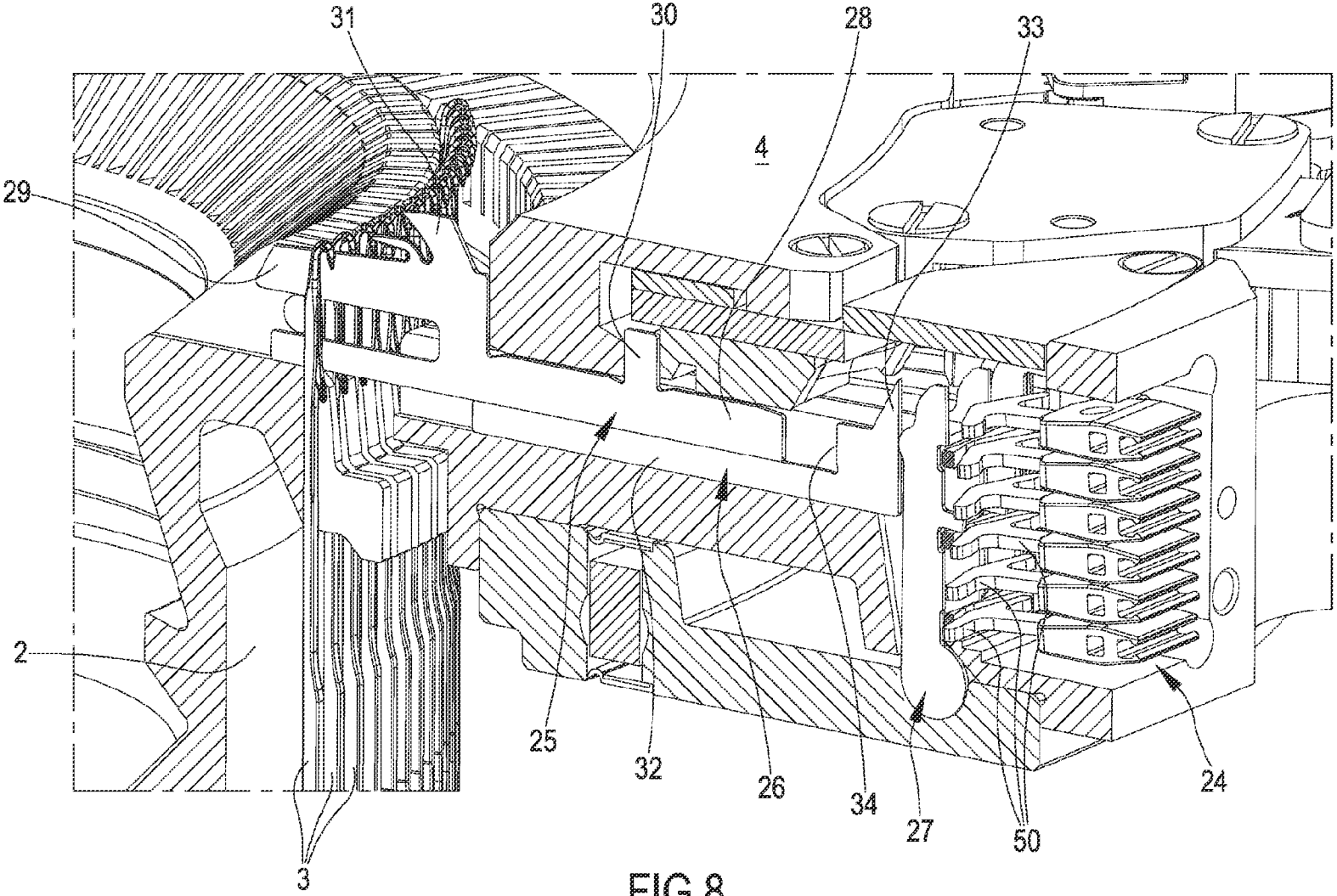
FIG. 8 shows a different, partially sectioned view of the portion of FIG. 1.

The switching from the rest to the operating position of the selector 11 is caused by selecting actuators 24 (FIGS. 2, 3 and 8) acting upon a tooth 23 of the selector 11 and whose structure shall be described in more detail below. In the embodiment shown by way of example, there are four selecting actuators 24 which are stationary with respect to the casing and are arranged at the same angular distance (90° from one another) around the crown 4. In particular, each of said selecting actuators 24 is located on a yarn feed.

Also the knockover sinker 7 is pushed by a respective pushing unit 10' and by a respective selector 11', which are wholly similar to the pushing unit 10 and to the selector 11. For this reason the same elements have been referred to with the same reference numerals with an apostrophe.

The selector 11' exhibits a base portion 21' and an abutment portion 22' at a distance from the base portion 21', pointing towards the central axis "X-X" and configured for indirectly acting upon the respective knockover sinker 7 through the respective pushing unit 10'.

The selector 11' further has a tooth 23' located on an edge of the flat element radially opposed to the abutment portion 22' and radially pointing outwards, i.e. to the opposed side with respect to the central axis "X-X". The abutment portion 22' has a rounded projection configured for resting against the radially outer end of the respective horizontal flat bar 18' of the pushing unit 10'.

Each of the pushing units 10' further exhibits a respective butt 19' and a respective abutment surface 20' configured for resting against the respective knockover sinker 7.

The knockover sinker 7 is further provided with a spring 31 so as to make terry stitches in cooperation with the needles 3.

As can be observed, the position of the tooth 23' of the selector 11' differs from the one of the teeth 23 of the two selectors 11, so that the selecting actuators 24 can catch the teeth 23 or as an alternative the teeth 23' depending on whether the first assembly should work for making a hole in the fabric or make a terry stitch, respectively.

Figures 9, 10:
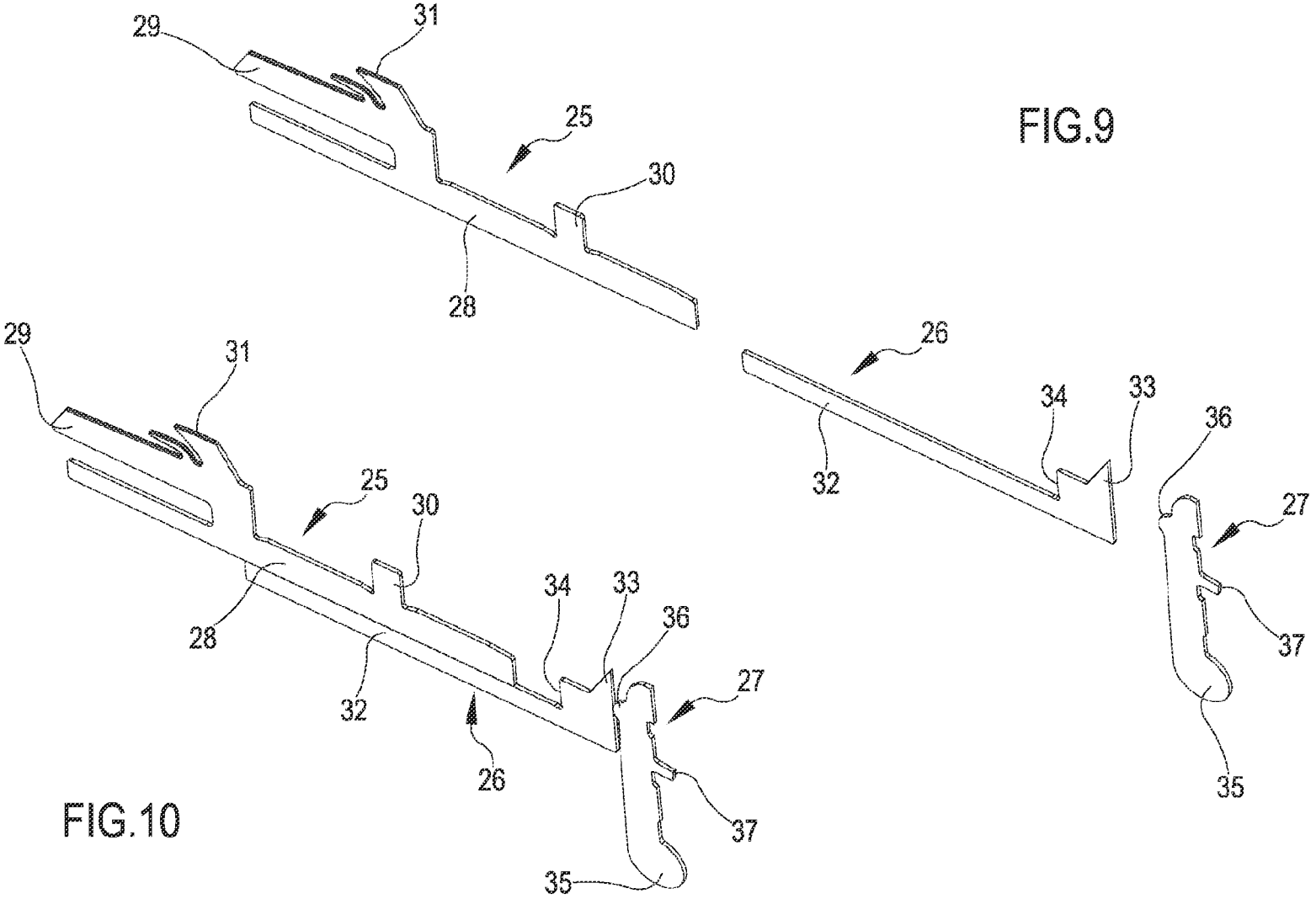
FIG. 9 shows an exploded view of a different assembly of elements belonging to the machine as in the preceding figures, which can be seen in FIG. 8.
FIG. 10 shows the assembly of FIG. 9 with the elements associated to one another.

Each of the auxiliary radial grooves 6 houses a second assembly which is also made up of a plurality of metal flat parts that can slide radially in the respective auxiliary radial groove 6 and also one with respect to the other. This second assembly, better shown in FIGS. 9 and 10, comprises an auxiliary knockover sinker 25, an auxiliary pushing unit 26 and an auxiliary selector 27.

The auxiliary knockover sinker 25 comprises a main body shaped as a horizontal flat bar 28 oriented as the auxiliary groove 6, i.e. along a radial direction, and a vertical flat upright developing from the horizontal flat bar 28. A pin 29 having a per se known shape develops from the vertical flat upright and faces the central axis "X-X" when the second assembly is properly mounted to the machine. The auxiliary knockover sinker 25 further comprises a flat butt 30 extending vertically upwards from the horizontal flat bar 28 and at a distance from a radially outer end (with respect to the central axis "X-X") of the horizontal flat bar 28. The auxiliary knockover sinker 25 further comprises a spring 31 located above the pin 29 and configured for making terry stitches in cooperation with the needles 3. The auxiliary knockover sinker 25 is basically identical with the knockover sinker 7, except for the presence of said spring 31. The auxiliary knockover sinker 25 is made up of a single flat metal part, e.g. a cut part.

The auxiliary pushing unit 26 of the second assembly is basically identical with each of the pushing units 10 of the first assembly. The auxiliary pushing unit 26 comprises a horizontal flat bar 32 and a butt 33 that is flat, is placed on a radially outer end, with respect to the central axis "X-X", of the horizontal flat bar 32 and extends vertically upwards. The auxiliary pushing unit 26 further has an abutment surface 34 facing the central axis "X-"X and configured for resting against the respective auxiliary knockover sinker 25. The abutment surface 34 of the auxiliary pushing unit 26 is placed near the butt 33 of said auxiliary pushing unit 26, i.e. near said radially outer end of the horizontal flat bar 32. More particularly, a portion of the auxiliary pushing unit 26 placed near said radially outer end extends vertically upwards and defines the abutment surface 34 and the respective butt 33. Also the auxiliary pushing unit 26 is made up of a single flat metal part, e.g. a cut part.

When the second assembly is properly mounted in the respective auxiliary groove 6 (FIG. 8), the horizontal flat bar 32 of each auxiliary pushing unit 26 is located under and in contact with the flat bar 28 of the respective auxiliary knockover sinker 25 and the abutment surface 34 faces the radially outer end of the respective auxiliary knockover sinker 25.

The auxiliary selector 27 of the second assembly is similar to the selector 11 of the first assembly. The auxiliary selector 27 is a metal flat element mainly developing vertically when it is properly mounted in the machine. The auxiliary selector 27 has a base portion 35 with a rounded profile and configured for oscillating around an axis tangent to a horizontal circumference with its center in the central axis "X-X". The auxiliary selector 27 lies and oscillates in a radial plane. The auxiliary selector 27 further exhibits an abutment portion 36 at a distance from the base portion 35, pointing towards the central axis "X-X" and configured for indirectly acting upon the respective auxiliary knockover sinker 25 through the respective auxiliary pushing unit 26. The auxiliary selector 27 further has a tooth 37 located on an edge of the flat element radially opposed to the abutment portion 36 and radially pointing outwards, i.e. to the opposed side with respect to the central axis "X-X". The abutment portion 36 has a rounded projection configured for resting against the radially outer end of the respective horizontal flat bar 32 of the auxiliary pushing unit 26.

The auxiliary selector 27 is oscillating in the radial plane between a rest position and an operating position. In the rest position, the abutment portion 36 of the auxiliary selector 27 is located in a radially outer position and does not get in contact with the respective auxiliary pushing unit 26. In the operating position, the auxiliary selector 27 is rotated towards the central axis "X-X", the abutment portion 36 of the auxiliary selector 27 is located in a radially inner position and is configured for resting and pushing against the auxiliary pushing unit 26. The auxiliary pushing unit 26 is configured for pushing against the auxiliary knockover sinker 25. The switching from the rest to the operating position of the auxiliary selector 27 is caused by the same selecting actuators 24 as mentioned above.

Figures 6, 7:
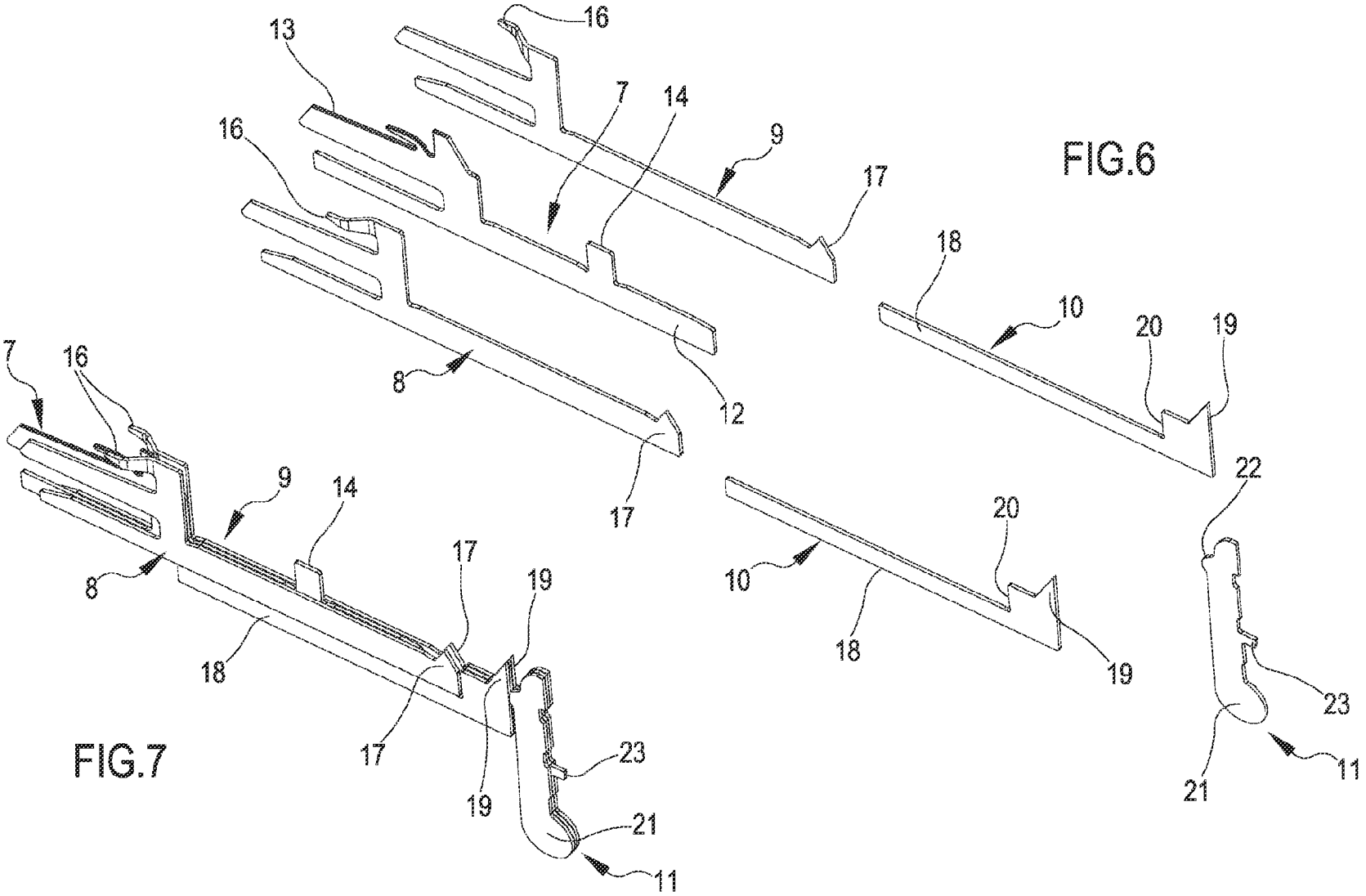
FIGS. 6 and 7 show a variant of the elements as in FIGS. 4 and 5.

In the variant of embodiment of the first assembly as shown in FIGS. 6 and 7, the knockover sinker 7 does not have the spring 31 for making terry stitches, and is not associated to a respective pushing unit 10' and to a respective selector 11'. Moreover, the first assembly is provided with one selector 11 only which acts simultaneously or almost simultaneously against the radially outer end of the horizontal flat bar 18 of both pushing units 10. The knockover sinker 7 of the variant of the first assembly of FIGS. 6 and 7 is operatively uncoupled from the selector 11 and from the pushing units 10 associated to the shaped sinker 8, 9, i.e. the selector 11 and the pushing units 10 do not interact with the knockover sinker 7 since they do not cause/control the movements thereof. In this variant of FIGS. 6 and 7, the use of auxiliary knockover sinkers 25 of the second assemblies (of the type shown in FIGS. 9 and 10) allows to make terry stitches (with the spring 31), whereas the use of knockover sinkers 7 as in the variant of the first assemblies (shown in FIGS. 6 and 7) does not allow to make terry stitches.

A guiding ring 38 (see FIG. 11), consisting of one or more parts, is operatively associated to the crown 4. The guiding ring 38 is coaxial with the central axis "X-X" and is stationary as the casing, i.e. the crown 4 is rotatable with respect to the guiding ring 38 around the central axis "X-X". The selecting actuators 24 are therefore stationary with respect to the guiding ring 38 and laterally face the crown 4. In the embodiment shown, the guiding ring 38 develops partly under and partly over the crown 4 and has a plurality of guides extending around the central axis "X-X" and configured for engaging with the above described metal parts of the first assembly and of the second assembly. These guides are for instance grooves delimited by cams.

The butt 14 of the knockover sinker 7 of each first assembly and the butt 30 of the auxiliary knockover sinker 25 of each second assembly engage into a first guide 39 obtained in an upper portion of the guiding ring 38. The first guide 39 is configured for radially moving the knockover sinkers 7 and the auxiliary knockover sinkers 25 along the respective radial grooves 5 and the respective auxiliary radial grooves 6 when the crown 4 rotates with respect to the guiding ring 38 and around the central axis "X-X".

Figure 11:
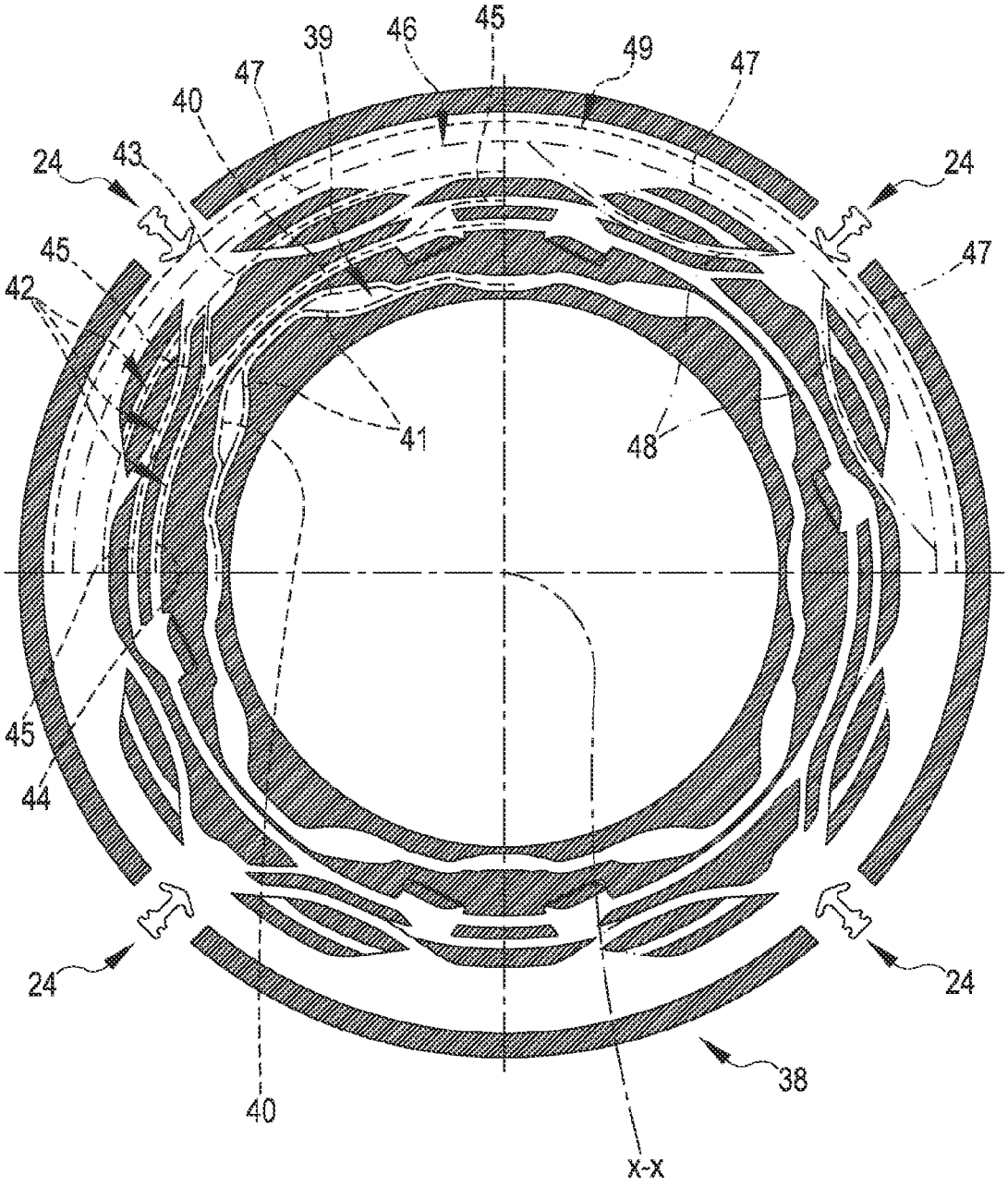
FIG. 11 shows a schematic plan view of a portion, including a guiding ring, of the machine as in the preceding figures.
Figure 12:
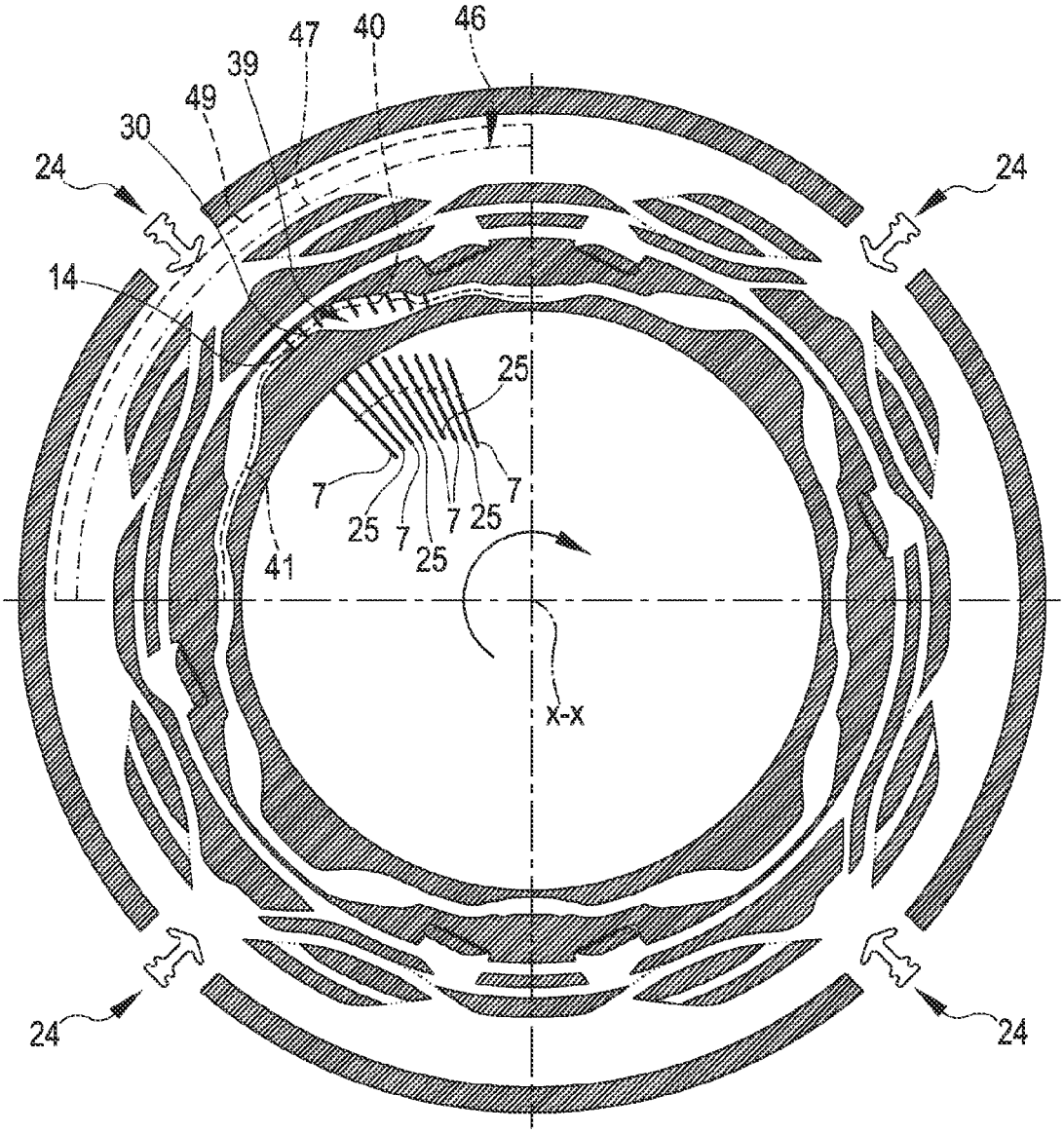
FIGS. 12 to 16 show the portion of FIG. 11, in which respective operating steps of the machine according to the invention are pointed out in a schematic manner.
Figure 13:
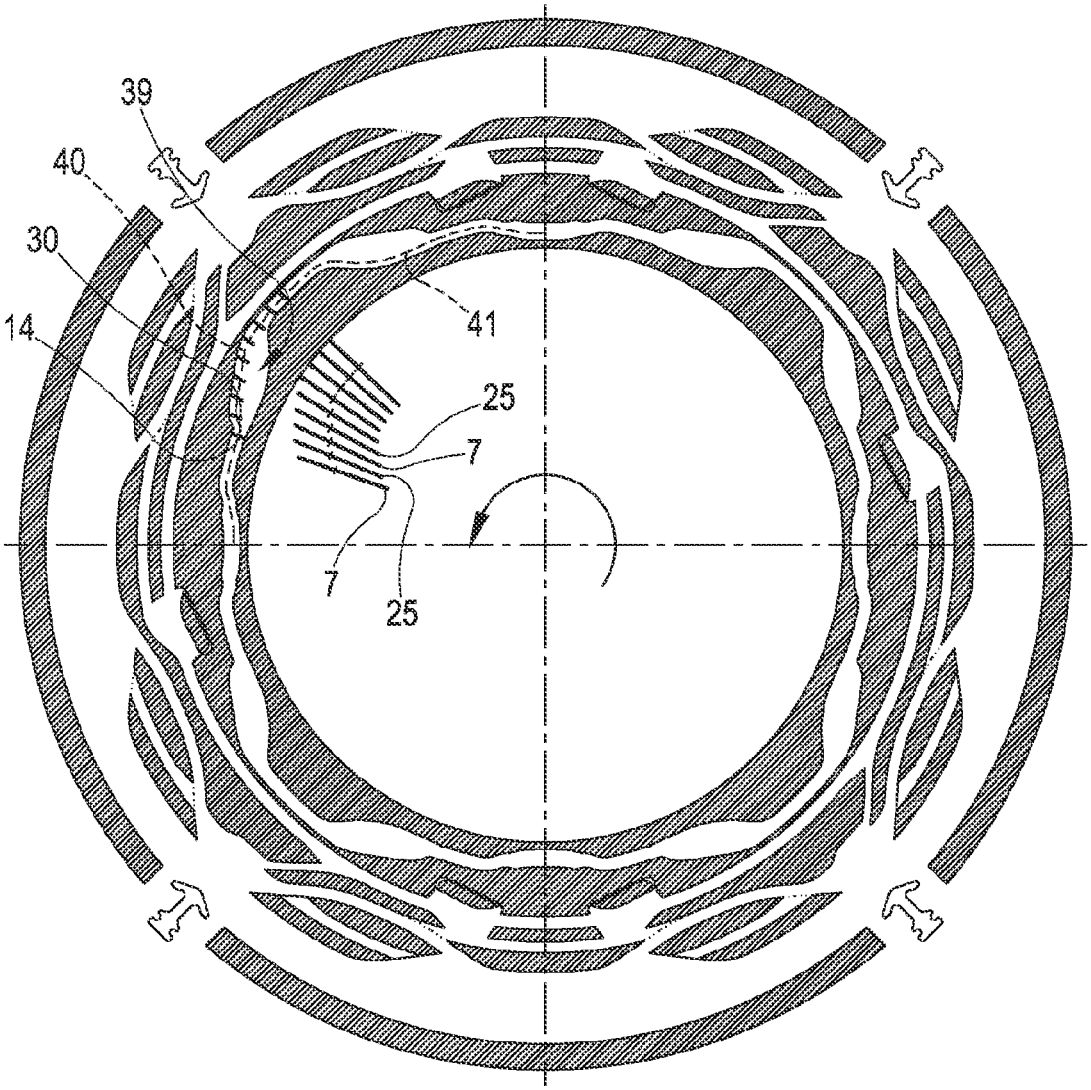
Figure 16:
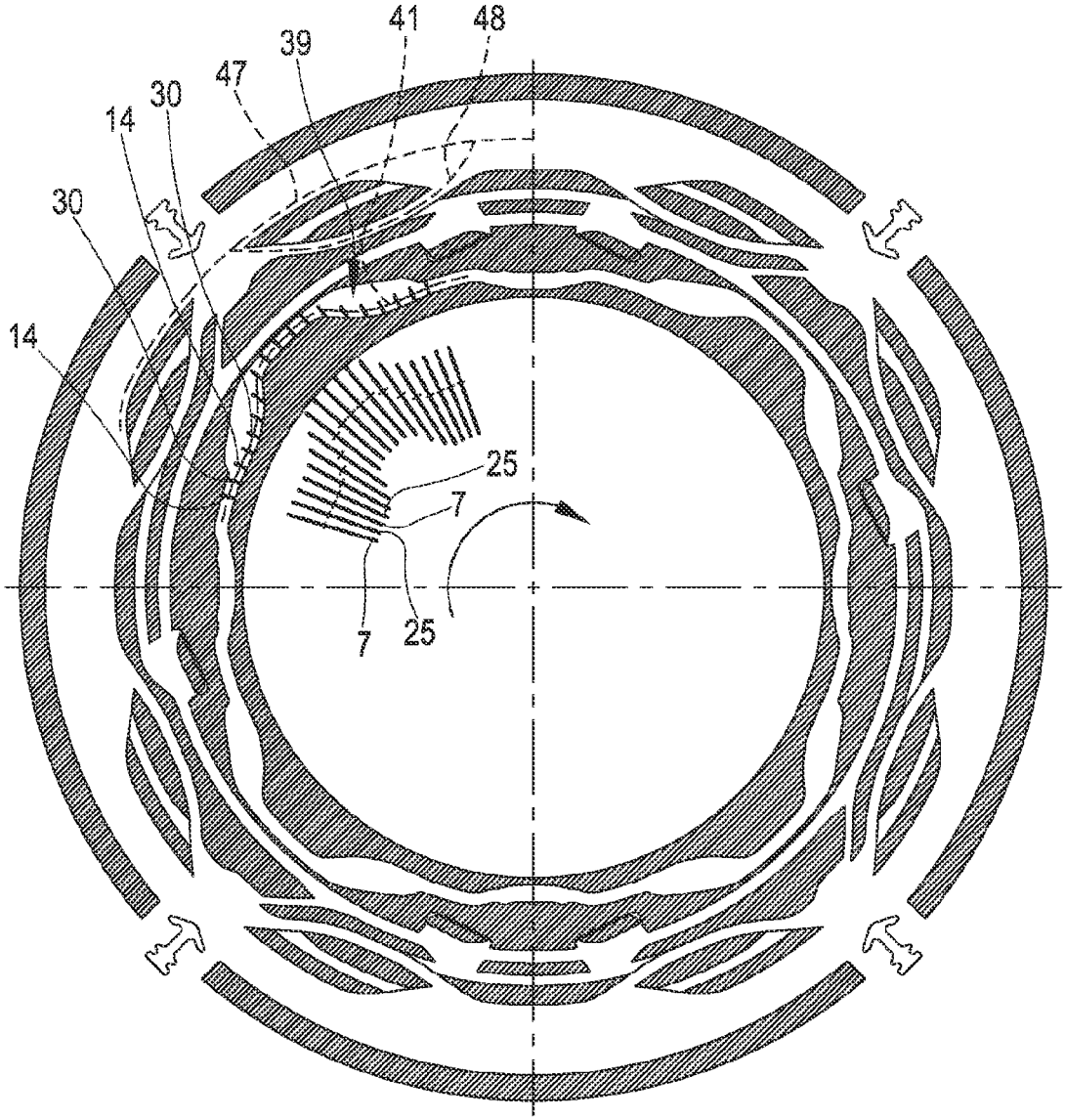

As can be seen in FIGS. 11 to 16, the first guide 39 has some portions with a radial width that basically corresponds to the size of the butts 14, 30 of the knockover sinker 7 and of the auxiliary knockover sinker 25, alternating with other wider portions. Said larger portions are provided with or define a respective radially outer path and a respective radially inner path (with respect to the central axis "X-X") for said butts 14, 30 and thus for the respective knockover sinker 7 and auxiliary knockover sinker 25. As a result, the first guide 39 defines a first trajectory 40 comprising said radially outer paths for all said wider portions, and a second trajectory 41 comprising radially inner paths for all said wider portions (FIGS. 12, 13 and 16). Two of said wider portions are positioned upstream and downstream from each yarn feed and from each selecting actuator 24.

The butts 17 of the first and of the second shaped sinker 8, 9 of each first assembly engage into a second guide 42, obtained again in the upper portion of the guiding ring 38. The second guide 42 is located in a radially outer position with respect to the first guide 39, i.e. it surrounds it. The second guide 42 comprises a plurality of paths defining a radially outer trajectory 43 that is basically circular, a radially inner path 44 that is basically circular, and a plurality of connecting portions 45 between the radially outer trajectory 43 and the radially inner trajectory 44 (FIG. 11).

The butts 19, 19' of the pushing units 10, 10' and the butts 33 of the auxiliary pushing units 26 engage into a third guide 46, obtained again in the upper portion of the guiding ring 38. Also the third guide 46 extends around the central axis "X-X" and defines a plurality of trajectories. In particular, the third guide 46 defines a radially outer trajectory 47 and a plurality of radially inner trajectories 48 placed one after the other around the central axis "X-X". The radially outer trajectory 47 of the third guide 46 is radially further outer with respect to the second guide 42, i.e. it surrounds it. Each of the radially inner trajectories 48 is bow-shaped and has opposed ends connected to the radially outer trajectory 47 of the third guide 46. Each of the radially inner trajectories 48 departs from the radially outer trajectory 47 of the third guide 46 getting near the central axis "X-X", and then gets away again from the central axis "X-X" then connecting again to the radially outer trajectory 47 of the third guide 46. Said radially inner trajectories 48 are superposed to the second guide 42, i.e. they define a part of the connecting portions 45 of the second guide 42. In the embodiment shown, there are eight radially inner trajectories 48. Said radially inner trajectories 48 are positioned upstream and downstream from each of the four yarn feeds and from each selecting actuator 24.

The base portion 21, 21' of all the selectors 11, 11', and the base portion 35 of all the auxiliary selectors 27 are housed in a circular track 49 extending around the central axis "X-X" so as to slide therein. The circular track 49 is obtained in a lower portion of the guiding ring 38 and delimits one circular trajectory lying out of the radially outer trajectory 47 of the third guide 46, i.e. it surrounds it.

Each of the selecting actuators 24, known per se, is of magnetic or piezoelectric type and comprises a plurality of levers 50 arranged one above the other and movable together between a first position, e.g. a raised position, and a second position, e.g. a lowered position.

In the first position, the levers lie at a distance from the teeth 23, 23', 37 of the selectors 11, 11' and of the auxiliary selectors 27 so as not to interfere with said teeth 23, 23', 37 when the selectors 11, 11' and the auxiliary selectors 27 are in their rest positions. In particular, in the first position said teeth 23, 23', 37 are positioned between the levers 50.

In the second position, the levers 50 interfere with the teeth 23 of the selectors 11 associated to the shaped sinkers 8, 9 and/or with the teeth 23' of the selectors 11' associated to the knockover sinkers 7 and/or with the teeth 37 of the auxiliary selectors 27 moving in front of the selecting actuator 24 when the crown 4 rotates with respect to the guiding ring 38 and around the central axis "X-X", so as to move the selectors 11, 11' and/or the auxiliary selectors 27 from the rest position to the operating position.

An electronic control unit, not shown, is operatively connected to the motor or motors causing the rotation of the needle-holding cylinder 2 and of the crown 4, to the selecting actuators 24 and to further actuating units, if any, of the machine. The electronic control unit is configured/programmed for commanding the motor or motors and the selecting actuators 24 and said further actuating units, if any, of the machine. In particular, the electronic control unit is configured/programmed for selectively moving the levers 50 of the selecting actuators 24 so as to move the selectors 11, 11' and the auxiliary selectors 27 singularly from the rest position to the operating position.

According to variants of embodiment that are not shown, the machine comprises only first assemblies circumferentially placed one beside the other (without second assemblies in between), and each of said first assemblies can comprise one or two shaped sinkers 8, 9 for forming the open work.

In use and according to the method or methods of the present invention, in order to manufacture a plain knitted fabric (FIGS. 12 and 13), while the needle-holding cylinder 2 rotates with respect to the casing and the crown 4 rotates with respect to the guiding ring 38 and around the central axis "X-X", the levers of the selecting actuators 24 are kept in the first position in which they do not interfere with the teeth 23 of the selectors 11, 11' and with the teeth 37 of the auxiliary selectors 27, which are therefore all in their respective rest positions.

The butts 19, 19' of the pushing units 10, 10' and the butts 33 of the auxiliary pushing units 26 go along the radially outer trajectory 47 of the third guide 46.

The butts 17 of the first and of the second shaped sinker 8, 9 of each first assembly go along the radially outer trajectory 43 of the second guide 42, and therefore the protrusions 16 of the respective shaped sinkers 8, 9 remain in a position radially at a distance from the central axis "X-X", i.e. in a retracted or rest position in which they do not interact with the yarn making the stitch.

The butts 14 of the knockover sinkers 7 and the butts 30 of the auxiliary knockover sinkers 25 therefore follow the first trajectory 40 of the first guide 39 causing a radial movement of the knockover sinkers 7 and of the auxiliary knockover sinkers 25. The knockover sinkers 7 and the auxiliary knockover sinkers 25 move forward and backward along respective radial directions so that the pins 13, 29 cooperate with the needles 3 for making the plain stitch (FIGS. 12 and 13). This operating mode can be implemented while the crown 4 rotates in clockwise direction, as in FIG. 12, or in counterclockwise direction, as in FIG. 13.

In order to make open work in the fabric (FIGS. 14 and 15), the control unit commands the selecting actuators 24 (by software control) so that they move the levers 50 from the first to the second position and then vice versa in programmed angular positions of the needle-holding cylinder 2 and of the crown 4, so as to catch specific selectors 11 of the shaped sinkers 8, 9 of specific first assemblies.

The control unit further commands the devices controlling the needles 3 (by software control) so as to move said needles 3 and make them cooperate properly:

with the knockover sinkers 7 of the variant of the first assembly (FIGS. 6 and 7) when forming plain fabric:

with the shaped sinkers 8, 9 when forming open work; and with the knockover sinkers 7 of the first assembly (FIG. 4), with the spring 31 and the auxiliary knockover sinkers 25 of the second assembly (FIGS. 9 and 10), also with the spring 31, when forming terrycloth.

Figure 14:
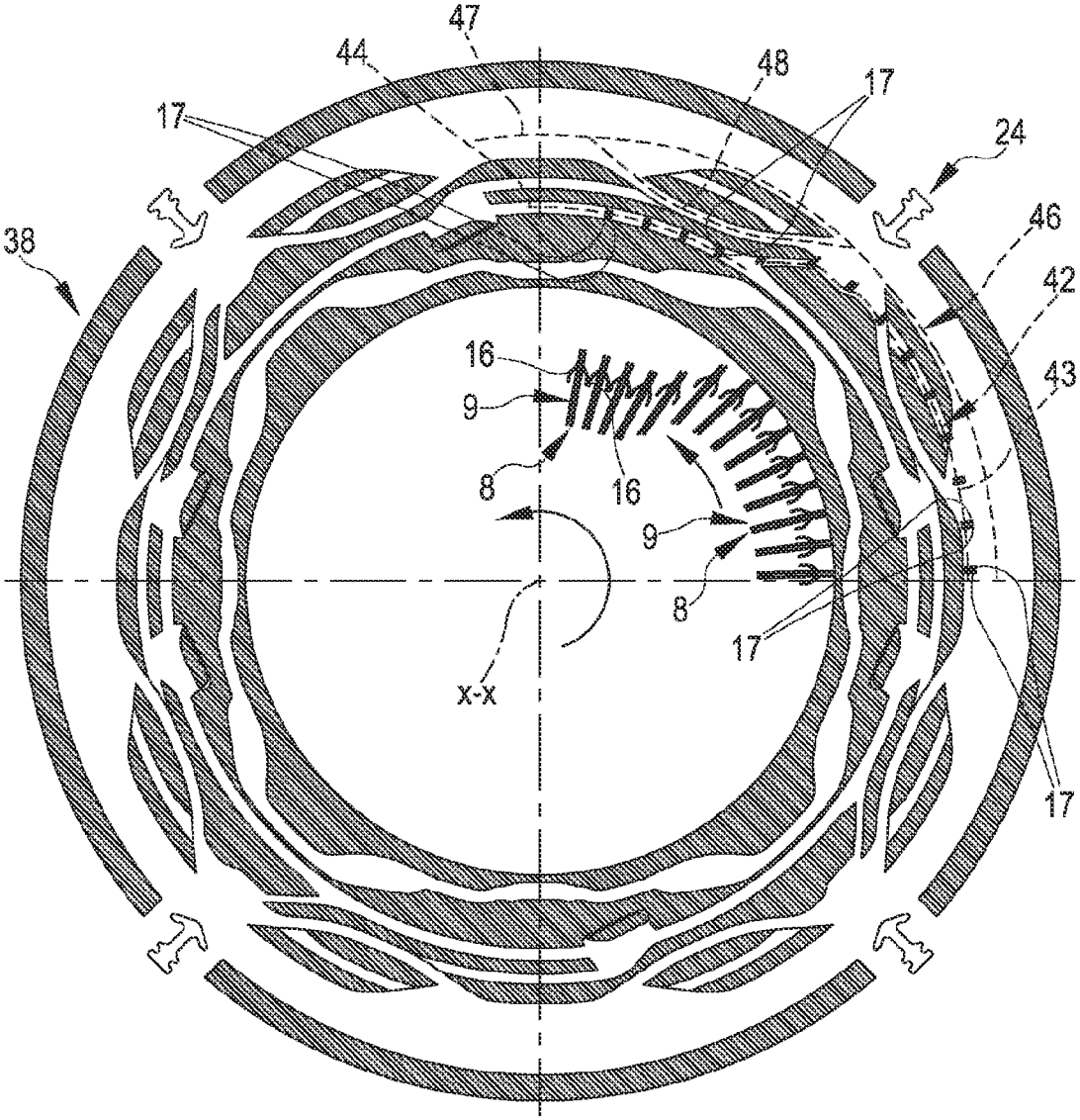
Figure 15:
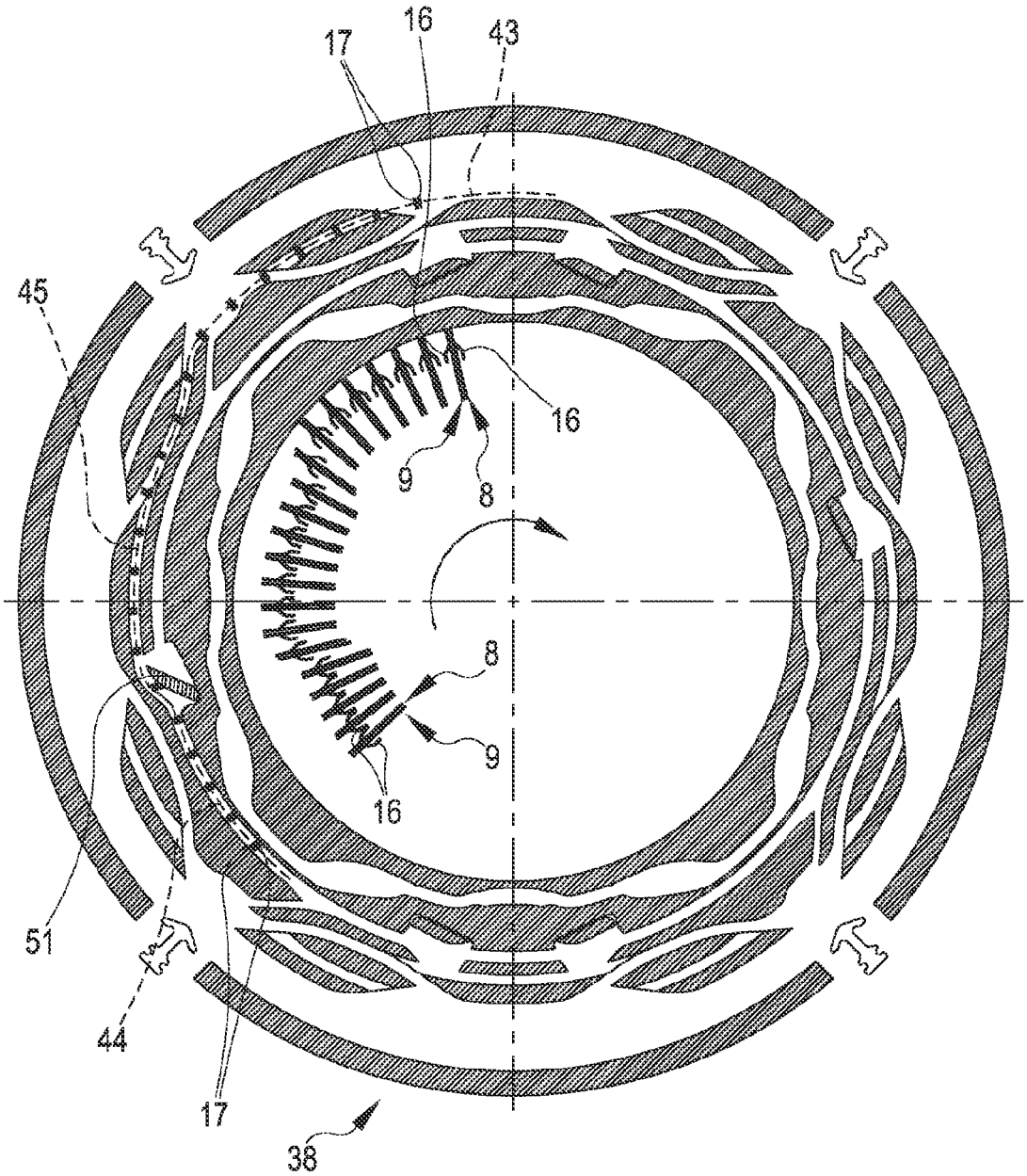

When forming open work, the selector or selectors 11 thus caught are moved to the operating position, whereas the selectors of the shaped sinkers 8, 9 of the first assemblies that are not selected, the selectors 11' of the knockover sinkers 7 and the auxiliary selectors 27 of the second assemblies are not caught and remain in their rest position. Referring for the sake of simplicity to a single selector 11, said selector 11 pushes the respective two pushing units 10 towards the central axis "X-X" so that the butts 19 of the pushing units 10 are deviated in the radially inner trajectory 48 of the third guide 46 placed immediately downwards of the selecting actuator 24 and follow it pushing in its turn the first and the second shaped sinker 8, 9. The butts 17 of the first and of the second shaped sinker 8, 9 go along one of the connecting portions 45 of the second guide 42 and get into the radially inner trajectory 44 of the second guide 42 and follow it for a preset angle of rotation described by the crown 4 and by the needle-holding cylinder 2 in counterclockwise direction (FIG. 14).

During this travel, which begins on the yarn feed preceding the one on which the stitch will be made, the first and the second shaped sinker 8, 9 are radially moved towards the central axis "X-X", whereas the needles 3 are kept in a lowered position and are then kept in such forward position.

Therefore, the pushing units 10, by following the radially inner trajectory 48 of the third guide 46, get back to the radially outer trajectory 47 of said third guide 46 and push the selector 11 back to the rest position. When the pair of shaped sinkers 8 and 9 reaches the feed in which the stitch is made, a knitted loop with elongated interstitches (open work) is formed, since the interstitches are loaded onto the protrusions 16 and not onto the pin 13 of the respective knockover sinker 7.

During a following rotation in clockwise direction of the crown 4 and of the needle-holding cylinder 2 (FIG. 15), the butts 17 of the first and of the second shaped sinker 8, 9 go along a portion of the radially inner trajectory 44 of the second guide 42 and are then deviated again on the radially outer trajectory 45 of the second guide 42 by a moving cam 51. During this travel, the first and the second shaped sinker 8, 9 are radially moved away from the central axis "X-X"

and are then kept in this position while the needles 3 are raised in a withdrawn position picking up the yarn of the interstitches on the protrusions 16.

In order to make terry stitches in the fabric (FIG. 16), the control unit commands the selecting actuators 24 so that they move the levers 50 from the first to the second position and then vice versa in programmed angular positions of the needle-holding cylinder 2 and of the crown 4, so as to catch specific selectors 11' of the knockover sinkers 7 of specific first assemblies and/or of specific auxiliary selectors 27 of specific second assemblies. The selectors of the shaped sinkers 8, 9, the selectors 11' of the other knockover sinkers 7 and the auxiliary selectors 27 of the other second assemblies are not caught and remain in their rest position.

Referring for the sake of simplicity to a single auxiliary selector 27, said auxiliary selector 27 pushes the respective auxiliary pushing unit 26 towards the central axis "X-X" so that the butt 33 of the pushing unit 26 is deviated in the radially inner trajectory 48 of the third guide 46 placed immediately downwards of the selecting actuator 24 and follow it pushing in its turn the respective knockover sinker 25. This radial push is exerted while the auxiliary knockover sinker 25 is in one of the widest portions of the first guide 39 and moves the auxiliary knockover sinker 25 on the second trajectory 41 of the first guide 39, i.e. it anticipates the radial entry of the auxiliary knockover sinker 25 with respect to the cams only of the first guide 39 when forming plain stitch as described above. Thus the spring 31 of the auxiliary knockover sinker 25 cooperates with a pair of needles 3 (in a per se known manner, which is not further described here) so as to form a terry stitch. This operating mode can be implemented while the crown 4 rotates in clockwise direction, as in FIG. 16, or in counterclockwise direction.

The present invention achieves important advantages both from a structural and a functional point of view.

As a matter of fact, by programming the control unit commanding the selecting actuators it is easily possible to make the desired selectors and/or auxiliary selectors operating and thus manufacture complex open-work and/or terrycloth knitted fabrics with the most different features.

The simultaneous presence of auxiliary knockover sinkers, for making terry stitches, alternating with traditional knockover sinkers placed beside the shaped sinkers, for making open work, allows to manufacture plain, terrycloth and open-work knitted fabric on the same machine with high flexibility and with the possibility of an alternating motion.

The machine according to the invention further allows to make open work and/or terry stitches and also other types of motifs with high speeds, thus dramatically reducing manufacturing times for even complex and sophisticated tubular knitted fabrics.

The control elements of said auxiliary knockover sinkers 25 and traditional knockover sinkers 7 placed beside the shaped sinkers 8, 9 are such as to allow said sinkers to be placed very close to one another and thus to obtain a compact machine. As a matter of fact, since the selectors 11, 27 do not act directly upon the shaped sinkers 8, 9 and upon the auxiliary knockover sinkers 25 but do so by deviating the trajectories of the pushing units 10, 26, which in their turn push the shaped sinkers 8, 9 and the auxiliary knockover sinkers 25, the selectors 11, 27 and also the selecting actuators 24 can be kept at a radial distance from the needles 3 and from the area where the stitch is formed, and the shaped sinkers 8, 9, the knockover sinkers 7 and the auxiliary knockover sinkers 25 can be moved circumferentially close to one another.

Such a machine is further relatively simple from a structural point of view and thus of easy maintenance.

Moreover, since many elements are similar or identical (e.g. pushing units and auxiliary pushing units, selectors, knockover sinkers and auxiliary knockover sinkers, right and left shaped sinkers) their manufacturing costs can be kept low, which positively affects the manufacturing costs of the machine as a whole.

The invention claimed is:

1. A circular knitting machine for manufacturing open-work knitted fabric, comprising:

a needle-holding cylinder (2) having a plurality of longitudinal grooves arranged around a central axis (X-X) of the needle-holding cylinder (2);

a plurality of needles (3), each being housed in a respective longitudinal groove;

at least one yarn feed operatively associated to the needles (3);

a crown (4) arranged around the needle-holding cylinder (2) and having a plurality of radial grooves (5);

at least one guiding ring (38) operatively associated to the crown (4), wherein the crown (4) is rotatable with respect to the guiding ring (38) and around the central axis (X-X);

a plurality of knockover sinkers (7), each housed in one of the radial grooves (5) and radially movable in the respective radial groove (5), each knockover sinker (7) having a pin (13) configured for cooperating with the needles (3) and a butt (14) engaged with a first guide (39) obtained in the guiding ring (38) and developing around the central axis (X-X); wherein the first guide (39) is configured for moving the knockover sinker (7) radially along the respective radial groove (5) when the crown (4) rotates with respect to the guiding ring (38) and around the central axis (X-X);

at least one shaped sinker (8, 9) placed beside each of the knockover sinkers (7), wherein the shaped sinker (8, 9) is movable with respect to the respective knockover sinker (7), wherein the shaped sinker (8, 9) has a protrusion (16) placed above the respective knockover sinker (7) and laterally offset with respect to said knockover sinker (7), wherein the protrusion (16) is configured for loading and extending an inter-stitch and place it on an adjacent needle of said plurality of needles (3) and make an open work, wherein the shaped sinker (8, 9) has a butt (17) that is or can be engaged with a second guide (42) obtained in the guiding ring (38) and developing around the central axis (X-X), wherein the second guide (42) defines a plurality of trajectories for the shaped sinker (8, 9), wherein the second guide (42) is configured for moving the shaped sinker (8, 9) radially when the crown (4) rotates with respect to the guiding ring (38) and around the central axis (X-X);

at least one selector (11) operatively coupled with said at least one shaped sinker (8, 9), wherein the selector (11) is movable in a radial plane between a rest position and an operating position, wherein in the operating position the selector (11) acts directly or indirectly upon said at least one shaped sinker (8, 9) so as to deviate the butt (17) of the shaped sinker (8, 9) along a trajectory of the second guide (42);

at least one selecting actuator (24) laterally facing the crown (4), fixed with respect to the guiding ring (38), that can be engaged under control with the selectors (11) and is configured for causing the selectors (11) to switch from the rest position to the operating position.

2. The machine according to claim 1, wherein said at least one shaped sinker (8, 9) comprises a right shaped sinker (8) and a left shaped sinker (9) arranged on opposed sides of the respective knockover sinker (7); wherein the right shaped sinker (8) and the left shaped sinker (9) have respective protrusions (16) placed above the respective knockover sinker (7) and laterally offset to opposed sides of said knockover sinker (7); wherein the protrusions (16) are configured for loading and extending the inter-stitch and place it on two adjacent needles (3) arranged on opposed sides of the respective knockover sinker (7) and make an open work; wherein each selector (11) acts indirectly upon the right shaped sinker (8) and/or the left shaped sinker (9).

3. The machine according to claim 1, wherein each knockover sinker (7) is operatively uncoupled from the selector (11) or wherein each knockover sinker (7) is operatively associated to a respective selector (11').

4. The machine according to claim 1, wherein each selector (11) is slidingly engaged in a circular track (49) obtained in the guiding ring (38) and extending around the central axis (X-X) so as to rotate with said at least one shaped sinker (8, 9).

5. The machine according to claim 4, comprising a plurality of pushing units (10), each associated to a respective selector (11) and to said at least one shaped sinker (8, 9); wherein in the operating position the selector (11) rests against the pushing unit (10) and the pushing unit (10) is configured for pushing against said at least one shaped sinker (8, 9).

6. The machine according to claim 5, wherein each pushing unit (10) has a butt (19) that is or can be engaged with a third guide (46) obtained in the guiding ring (38), extending around the central axis (X-X) and defining a plurality of trajectories.

7. The machine according to claim 6, wherein said at least one shaped sinker (8, 9) is housed in one of the radial grooves (5) together with the respective knockover sinker (7); wherein the respective selector (11) is placed radially outside with respect to said radial groove (5) and has at least one abutment portion (22) facing said radial groove (5).

8. The machine according to claim 7, wherein the pushing unit (10) is housed in the radial groove (5) together with the respective knockover sinker (7) and with said at least one shaped sinker (8, 9), and said abutment portion (22) of the respective selector (11) faces a radially outer end of the pushing unit (10).

9. The machine according to claim 1, wherein said at least one selecting actuator (24) comprises at least one selecting lever (50) movable between a first position, in which it lies at a distance from the selectors (11), and a second position, in which it interferes with the selectors (11) moving in front of the selecting actuator (24) when the crown (4) rotates with respect to the guiding ring (38) and around the central axis (X-X), so as to move the selectors (11) from the rest position to the operating position.

10. The machine according to claim 6, wherein the crown (4) has a plurality of auxiliary radial grooves (6), each placed between two radial grooves (5); wherein the machine comprises a plurality of auxiliary knockover sinkers (25), each housed in one of the auxiliary radial grooves (6) and movable radially in the respective auxiliary radial groove (6); each auxiliary knockover sinker (25) having a pin (29) configured for cooperating with the needles (3) and a butt (30) engaged with the first guide (39); wherein the first guide (39) is configured for moving the auxiliary knockover sinker (25) radially along the respective auxiliary radial groove (6) when the crown (4) rotates with respect to the guiding ring (38) and around the central axis (X-X); wherein each auxiliary knockover sinker (25) further comprises a spring (31) arranged above the pin (29) and configured for making different stitches.

11. The machine according to claim 10, comprising an auxiliary selector (27) operatively coupled with each auxiliary knockover sinker (25) and basically identical with the selector (11), wherein the auxiliary selector (27) is movable in a radial plane between a rest position and an operating position, wherein in the operating position the auxiliary selector (27) acts indirectly upon said at least one auxiliary knockover sinker (25) so as to deviate the butt (30) of the auxiliary knockover sinker (25) along a trajectory of the first guide (39); wherein the auxiliary selector (27) acts indirectly upon an end of the respective auxiliary knockover sinker (25) radially opposed with respect to the pin (29).

12. The machine according to claim 10, wherein each auxiliary selector (27) is slidingly engaged in the circular track (49) so as to rotate together with the respective auxiliary knockover sinker (25).

13. The machine according to claim 10, comprising a plurality of auxiliary pushing units (26), each associated to a respective auxiliary selector (27) and to said at least one auxiliary knockover sinker (25); wherein in the operating position the auxiliary selector (27) rests against the auxiliary pushing unit (26) and the auxiliary pushing unit (26) is configured for pushing against said at least one auxiliary knockover sinker (25); wherein each auxiliary pushing unit (26) has a butt (33) that is or can be engaged in the third guide (46).

14. The machine according to claim 1, wherein the first guide (39) is radially inner, relating to the central axis (X-X), with respect to the second guide (42); wherein the second guide (42) defines a radially outer trajectory (43), a radially inner trajectory (44) and a plurality of connecting portions (45) between the radially outer trajectory (43) and the radially inner trajectory (44).

15. The machine according to claim 6, wherein the third guide (46) defines a radially outer trajectory (47) and a plurality of radially inner trajectories (48) placed one after the other around the central axis (X-X), each of the radially inner trajectories (48) having opposed ends connected to the radially outer trajectory (47).

16. The machine according to claim 15, wherein the second guide (42) is radially inner, relative to the central axis (X-X), with respect to the radially outer trajectory (47) of the third guide (46).

17. The machine according to claim 4, wherein the circular track (49) is radially outer, relative to the central axis (X-X), with respect to the second guide (42) and/or to the third guide (46).

18. A method for manufacturing knitted fabric using a machine according to claim 1, wherein the method comprises: keeping the selectors (11) and the auxiliary selectors (27) in the rest position, while the crown (4) rotates with respect to the guiding ring (38) and around the central axis (X-X), so as to move the shaped sinkers (8, 9) along the radially outer trajectory (43) of the second guide (42) and to move the auxiliary knockover sinkers (25) along a first trajectory (40) of the first guide (39), the knockover sinkers (7) moving along said first trajectory (40) of the first guide (39) like the auxiliary knockover sinkers (25), so as to make a plain knitted fabric; wherein, while the selectors (11) and the auxiliary selectors (27) are in the rest position, the pushing units (10) and the auxiliary pushing units (26) move along the radially outer trajectory (47) of the third guide (46); wherein the pushing units (10) are radially at a distance from the respective shaped sinkers (8, 9); wherein the auxiliary pushing units (26) are radially at a distance from the respective auxiliary knockover sinkers (25).

19. The method for manufacturing knitted fabric using a machine according to claim 1, wherein the method comprises: engaging said at least one selecting actuator (24) with at least one of the selectors (11) so as to move said at least one selector (11) in the operating position for at least one rotational portion of the crown (4) around the central axis (X-X), wherein the auxiliary selectors (27) are kept in the rest position, so as to move said at least one shaped sinker (8, 9) associated to said at least one selector (11) on the radially inner trajectory (44) of the second guide (42) and move the protrusion (16) towards the central axis (X-X) for at least one rotational portion of the crown (4) around said central axis (X-X), so as to make an open work in the fabric by cooperating with at least one needle (3); wherein the pushing unit (10), associated to said at least one of the selectors (11), is pushed radially by the respective selector (11) towards the central axis (X-X) so as to get over one of the radially inner trajectories (48) of the third guide (46), and pushed said at least one shaped sinker (8, 9) on the radially inner trajectory (44) of the second guide (42).

20. The method for manufacturing knitted fabric using a machine according to claim 10, wherein the method comprises: engaging said at least one selecting actuator (24) with at least one of the auxiliary selectors (27) so as to move said at least one auxiliary selector (27) in the operating position for at least one rotational portion of the crown (4) around the central axis (X-X), wherein the selectors (11) are kept in the rest position, so as to move said at least one auxiliary knockover sinker (25) associated to said at least one auxiliary selector (27) on the second trajectory (41) of the first guide (39), so that the spring (31) of the auxiliary knockover sinker (25) makes a terry stitch by cooperating with at least one needle (3).

* * * * *